US011905686B2

(12) United States Patent
Serrurier et al.

(10) Patent No.: US 11,905,686 B2
(45) Date of Patent: Feb. 20, 2024

(54) REPLACEABLE WEAR PLATE

(71) Applicant: Caterpillar Inc., Peoria, IL (US)

(72) Inventors: Douglas C. Serrurier, Morton, IL (US); Andrew William Young, New Braunfels, TX (US); Graham Ray Hartoonian-Parizek, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 180 days.

(21) Appl. No.: 17/387,463

(22) Filed: Jul. 28, 2021

(65) Prior Publication Data

US 2023/0036427 A1 Feb. 2, 2023

(51) Int. Cl.
*E02F 9/28* (2006.01)

(52) U.S. Cl.
CPC ..... *E02F 9/2883* (2013.01)

(58) Field of Classification Search
CPC ..... E02F 9/2883; E02F 9/28; E02F 9/2816; E02F 9/2858; E02F 9/285; E02F 9/2808; E02F 3/8152
See application file for complete search history.

(56) References Cited

U.S. PATENT DOCUMENTS

| | | | | | |
|---|---|---|---|---|---|
| 4,057,294 | A * | 11/1977 | Krekeler | E02F 9/2866 | 82/158 |
| 5,564,508 | A * | 10/1996 | Renski | E02F 9/2883 | 37/456 |
| 5,913,605 | A | 6/1999 | Jusselin et al. | | |
| 5,937,549 | A * | 8/1999 | Bender | E02F 9/2825 | 172/772 |
| 6,041,529 | A * | 3/2000 | Ruvang | E02F 9/2833 | 172/772 |
| 6,194,080 | B1 * | 2/2001 | Stickling | E02F 9/2841 | 428/596 |
| 7,770,310 | B2 * | 8/2010 | Keech | E02F 3/8155 | 37/455 |
| 9,371,631 | B2 * | 6/2016 | Karlsson | E02F 9/2858 | |
| 9,938,695 | B2 * | 4/2018 | Bjerke | E02F 9/2816 | |
| 10,060,099 | B2 | 8/2018 | Serrurier et al. | | |
| 10,428,494 | B1 * | 10/2019 | Lombardo | E02F 9/2883 | |
| 10,947,704 | B2 * | 3/2021 | Bjerke | E02F 9/2833 | |
| 2003/0007831 | A1 * | 1/2003 | Lian | E02F 9/2841 | 403/374.1 |
| 2014/0373400 | A1 | 12/2014 | Sheehan et al. | | |
| 2015/0191899 | A1 * | 7/2015 | Jones | E02F 9/2883 | 37/444 |
| 2018/0073543 | A1 * | 3/2018 | Bjerke | F16B 37/14 | |

FOREIGN PATENT DOCUMENTS

| | | | | |
|---|---|---|---|---|
| CA | 2036118 | A1 | 8/1991 | |
| WO | WO-2017059009 | A1 * | 4/2017 | E02F 3/40 |
| WO | 2021011994 | A1 | 1/2021 | |
| WO | WO-2021011994 | A1 * | 1/2021 | B65G 11/166 |

* cited by examiner

*Primary Examiner* — Jessica H Lutz
*Assistant Examiner* — Blake E Scoville

(57) ABSTRACT

A wear member includes a body defining an exterior with an outside perimeter, an interior aperture with an at least partially interior polygonal perimeter, and at least one fastener receiving hole extending from the exterior to the interior aperture. The exterior lacks any large openings to limit the risk of material packing.

14 Claims, 26 Drawing Sheets

REPLACEABLE WEAR PLATE

TECHNICAL FIELD

The present disclosure relates generally to a wear member, and more particularly, to a wear member that may be attached to a mounting base.

BACKGROUND

Many earth-working machines, such as, for example, loaders, excavators, hydraulic mining shovels, cable shovels, bucket wheels, and draglines, include tools for moving material (e.g., for digging material out of the earth). These tools are often subjected to extreme wear from abrasion and impacts experienced while moving the material. In order to mitigate the wear, replaceable wear members are fit to the tools and engage the material being moved.

U.S. Pat. No. 5,937,549 (the '549 patent) to Bender et al. describes an attachment system for detachably mounting a wear member to a parent member. According to the '549 patent, the attachment system includes a mounting base, which is welded to a single surface of the parent member. The attachment system also includes a wear member, which is mechanically attached to the single surface of the parent member by sliding the wear member onto the mounting base and engaging cooperating engagement elements. Once the wear member is slid onto the mounting base, the '549 patent describes using a removable retainer to maintain the position of the wear member. The wear member may be replaced by removing the retainer and sliding the wear member off of the base, thereby disengaging the cooperating mounting elements.

The attachment system of the '549 patent may provide certain benefits in some applications. However, it may have certain drawbacks. For example, it may be difficult and/or costly to use the attachment system of the '549 patent in applications requiring a wear member that mitigates wear to multiple, non-parallel (e.g., perpendicular) surfaces of a tool. The disclosed embodiments may help solve this and other problems.

Also, the wear members may be placed on different portions of the work tool (e.g., a bucket, a dipper, etc.). The amount and type of wear inflicted on exterior wear members may be different than that inflicted on interior wear members. For example, the interior wear members placed inside of a bucket or a dipper may experience harsher wear, or may experience packing of material that makes removal of a wear member for a mounting system difficult.

U.S. Pat. No. 6,041,529 A discloses a wear runner assembly that is attached to a surface of an excavating bucket and serves to protect a portion of the surface from abrasion wear during use of the bucket. The assembly includes a base member, a wear runner member, a pair of bolts and a pair of conical locking nuts. The base member is welded to the surface and has a pair of undercut slots that captively retain the head portions of the bolts, with the bolt bodies being transverse to the surface and projecting outwardly beyond the outer side of the base member. The wear runner member is mounted on the base member by moving the wear runner member toward the base member in a direction transverse to the surface in a manner causing the outwardly projecting bolt body portions to enter and be recessed within a pair of openings formed through the wear member, and also causing projections on the base member to be complementarily received within recesses formed in the wear runner member. Finally, conical locking nuts are threaded onto the bolt bodies recessed within the wear runner member openings to releasably hold the wear runner member on the base member. The interlock between the base member projections and the wear runner member recesses prevents operating loads imposed on the assembly from moving the wear runner member relative to the base member parallel to the protected surface to thereby prevent the bolts from being sheared by such operating loads.

However, operating loads are exerted on projections of the base member, making it vulnerable to shearing or other damage. So, a more robust system is warranted.

SUMMARY OF THE DISCLOSURE

A wear member mounting system according to an embodiment of the present disclosure may comprise a mounting base including an at least partially external polygonal perimeter, an interior weld receiving aperture, and at least one dovetail slot. The wear member mounting system may further comprise a wear member defining an aperture with an at least partially interior polygonal perimeter that is configured to mate with the at least partially external polygonal perimeter of the mounting base, and at least one dovetail fastening subassembly including a dovetail member including a body that is configured to at least partially complementarily fill the at least one dovetail slot. A fastener receiving aperture extending through the body that defines a round portion and a non-round portion.

A wear member according to an embodiment of the present disclosure may comprise a body defining an exterior with an outside perimeter, an interior aperture with an at least partially interior polygonal perimeter, and at least one fastener receiving hole extending from the exterior to the interior aperture.

A dovetail fastening subassembly according to an embodiment of the present disclosure may comprise a dovetail member including a body that has an at least partial pyramidal configuration defining a fastener receiving aperture extending through the body that defines a surface of revolution, and a surface of non-revolution.

A mounting plate according to an embodiment of the present disclosure may comprise a plate body defining a plate length, a plate width, and a plate thickness that is less than the plate length and plate width. The plate body may further define an internal dovetail slot, an external dovetail slot, a T-slot that is in communication with and partially forms the internal dovetail slot, and an elongated slot disposed between the T-slot, and the external dovetail slot along a direction parallel with the plate length. A pair of pry slots may be disposed on either side of the external dovetail slot along a direction parallel with the plate width, and an elongated pry slot may be disposed proximate to the internal dovetail slot along a direction parallel with the plate length.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 2:
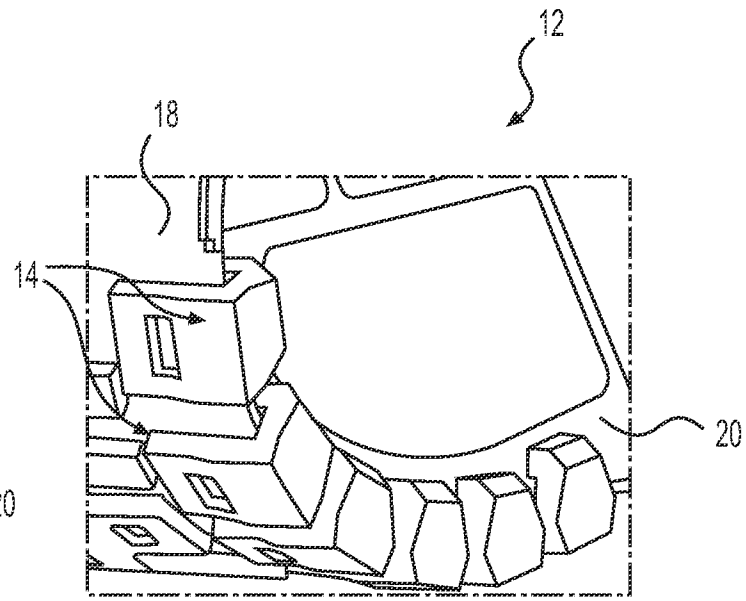
FIG. 2 is an enlarged perspective view of several of the wear member systems of FIG. 1.
Figure 1:
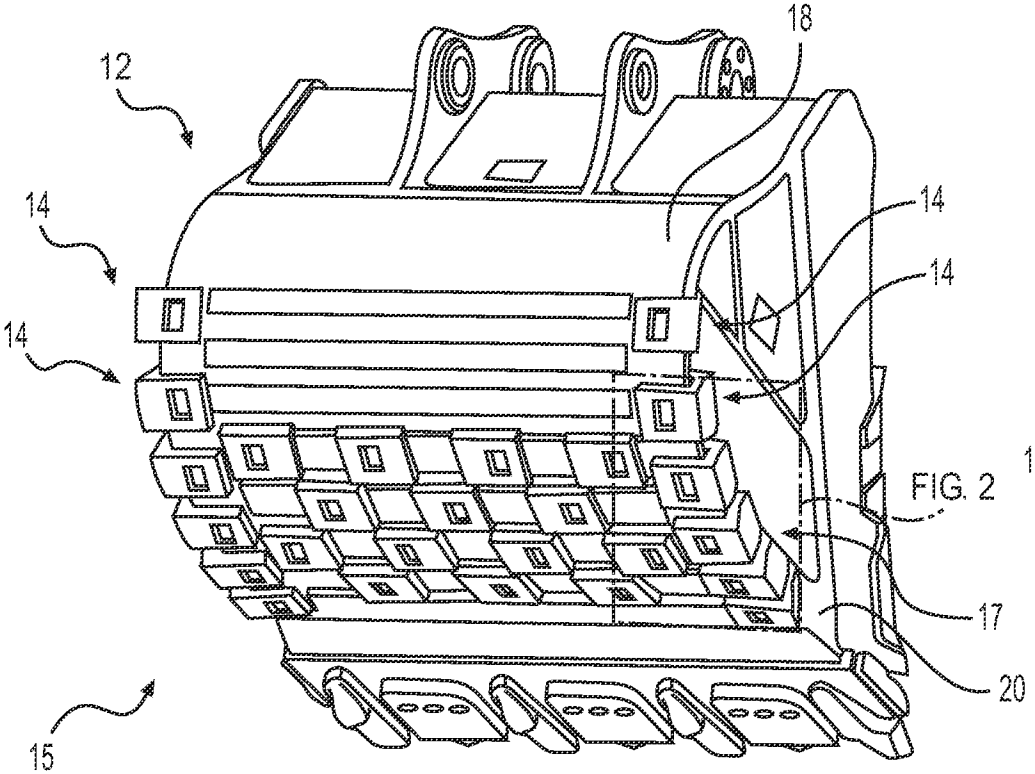
FIG. 1 is a perspective view of a plurality of exemplary disclosed wear member systems installed on a tool.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification FIGS. 1-2 illustrate exemplary wear member systems 14, which may be attached to a tool 12. For example, tool 12 may be a bucket (as shown in FIG. 1), a blade, a shovel, a crusher, a grapple, or a ripper, and may be associated with an earth-working machine (e.g., a loader, an excavator, a hydraulic mining shovel, a cable shovel, a bucket wheel, a dragline, or another type of earth-working machine). Tool 12 may be used for moving material (e.g., for digging material out of the earth). Wear member systems 14 may be attached to heels 15, 17 of tool 12, and may mitigate wear from abrasion and impacts experienced by heels 15, 17 while moving the material.

Figure 3:
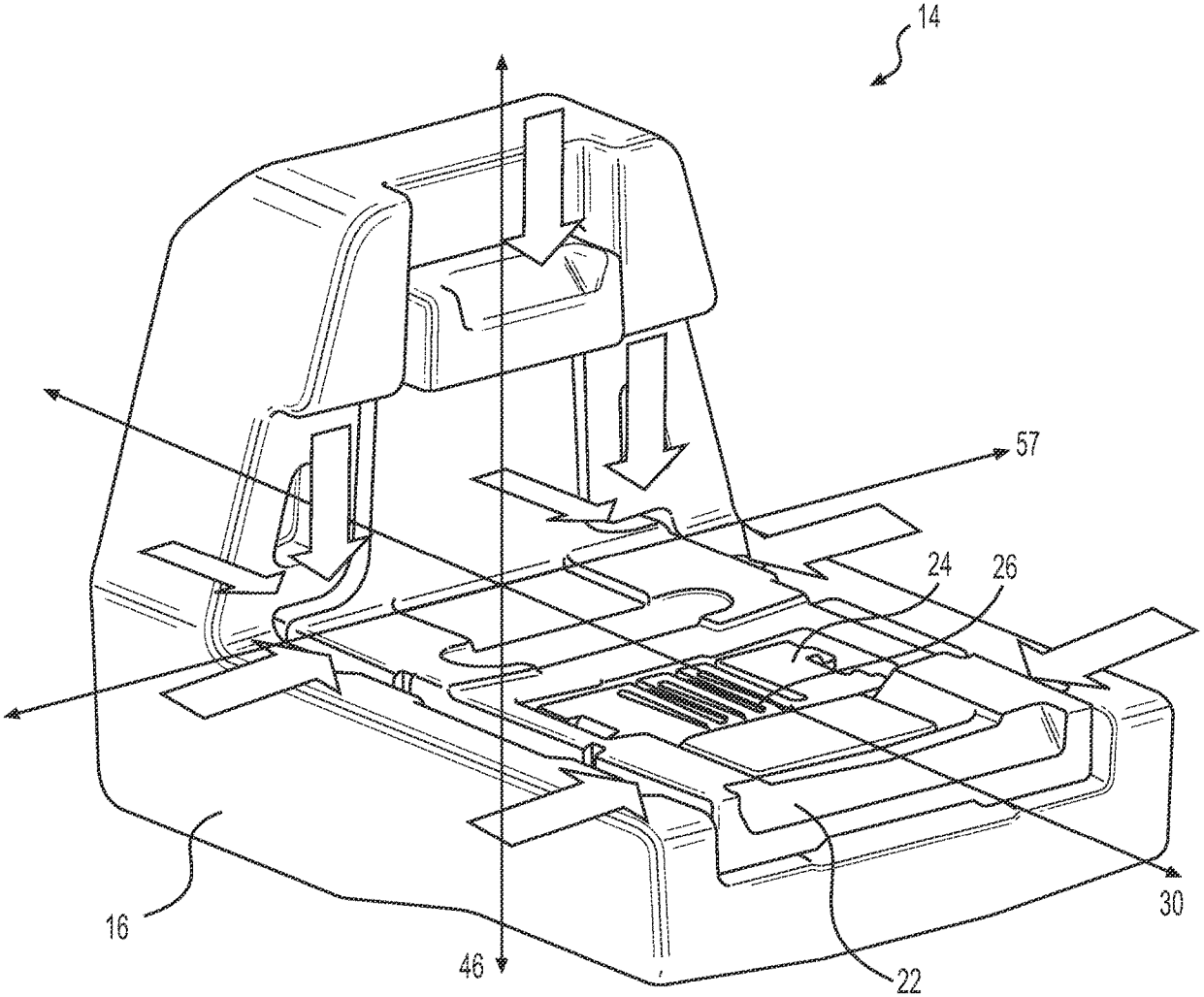
FIG. 3 is a perspective view of one of the wear member systems of FIGS. 1 and 2.
Figure 5:
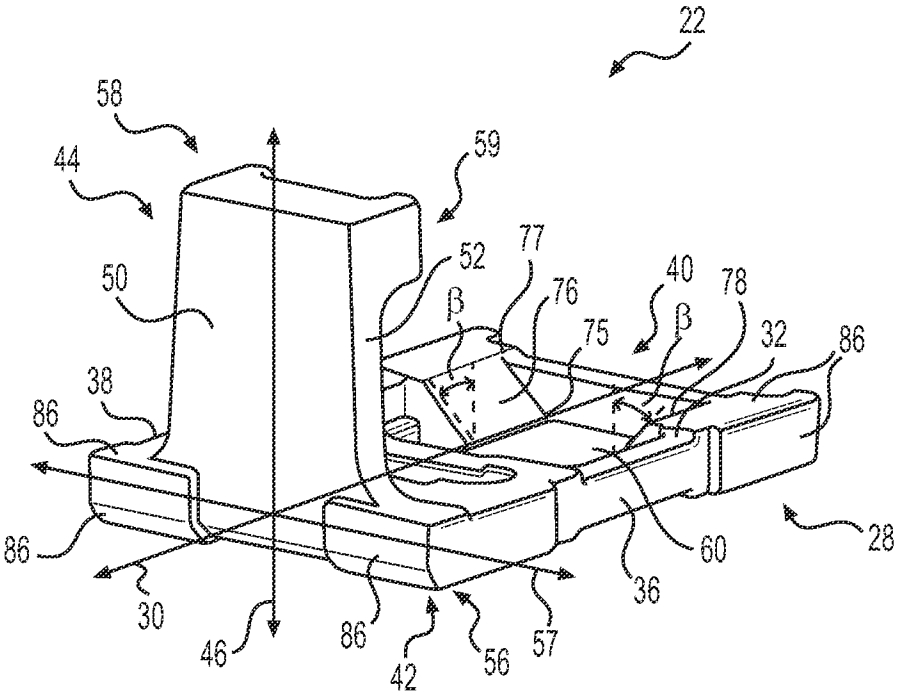
FIG. 5 is another perspective view of the mounting base of FIG. 3, from a different angle.
Figure 4:
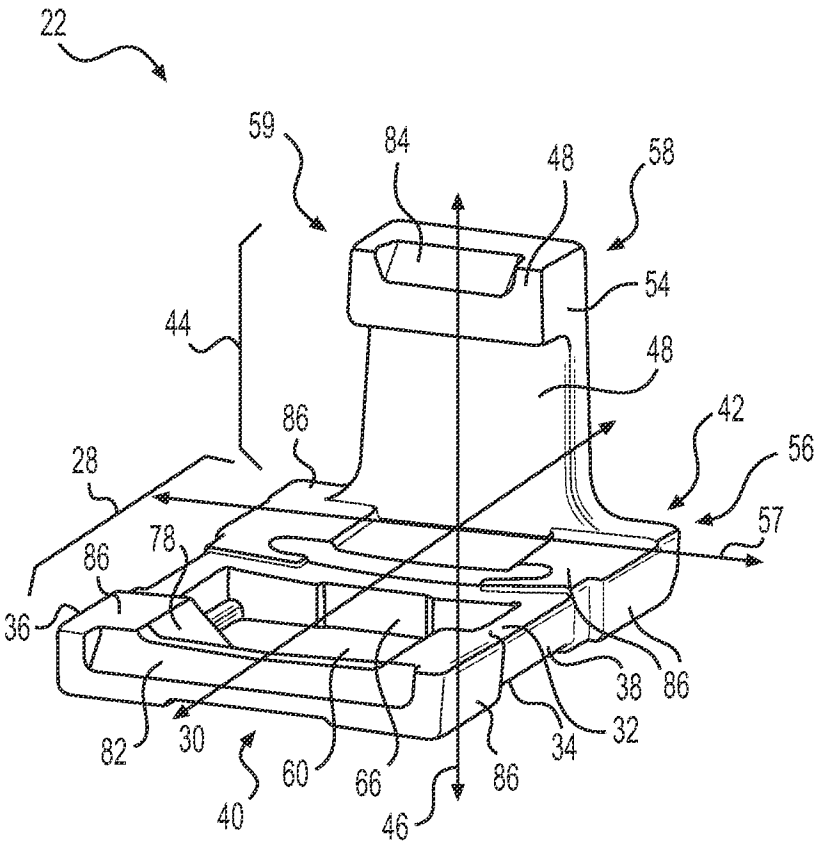
FIG. 4 is a perspective view of an exemplary disclosed mounting base of the wear member system of FIG. 3.
Figure 7:
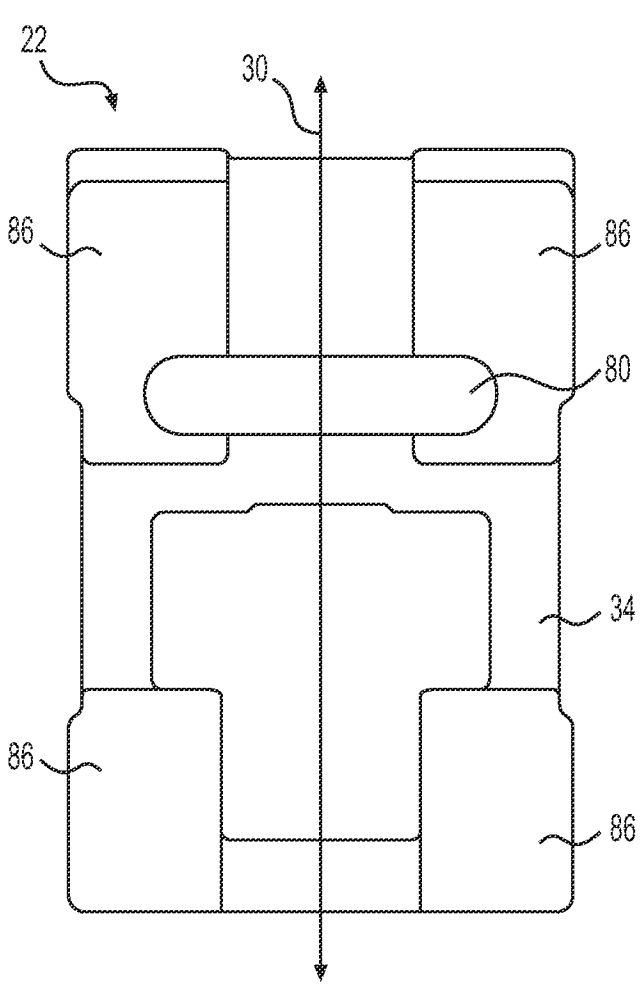
FIG. 7 is a bottom view of the mounting base of FIGS. 4-6.
Figure 6:
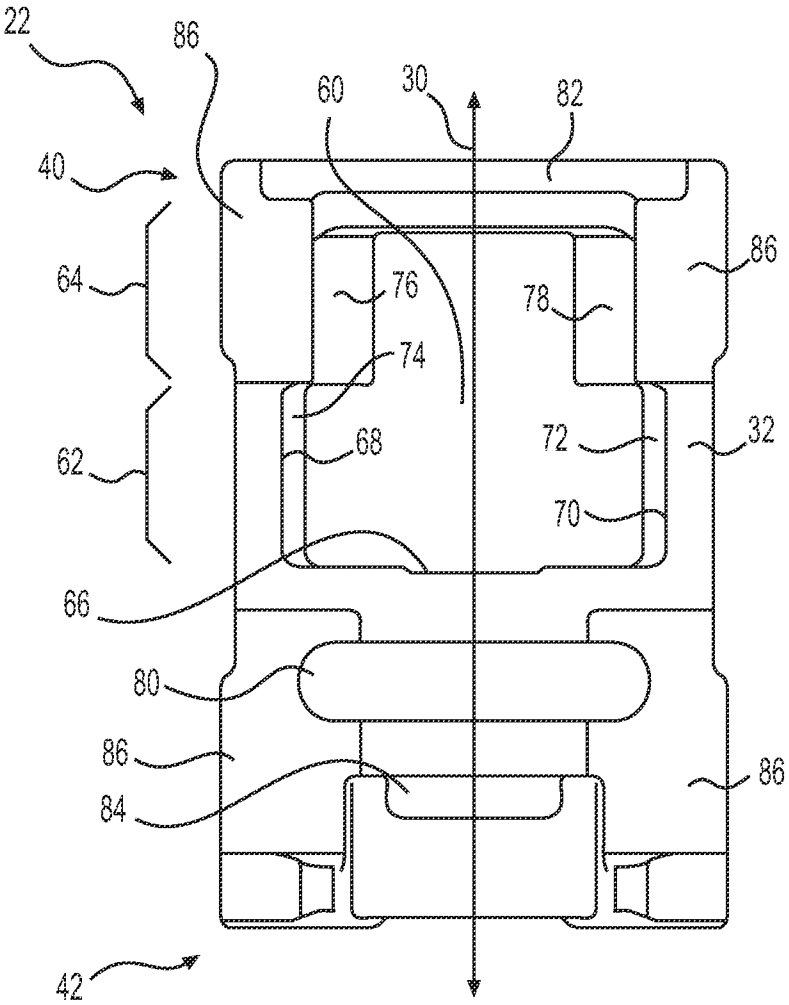
FIG. 6 is a top view of the mounting base of FIGS. 4-5.

Referring to FIG. 3, each wear member system 14 may include a mounting base 22, a wear member 16, a retainer 24, and a plug 26. Mounting base 22 may be configured to be attached (e.g., fixedly) to a first surface 18 and a second surface 20 of tool 12 (referring to FIGS. 1-2). Wear member 16 may be configured to be removably coupled to tool 12 via mounting base 22. Retainer 24 may be configured to keep wear member 16 coupled to mounting base 22 when in a mounted position, and plug 26 may be configured to protect retainer 24.

FIGS. 4-11 illustrate an exemplary mounting base 22 from a variety of angles. As shown, mounting base 22 may include a generally planar first base portion 28 that extends in a longitudinal direction 30. Mounting base 22 may also include a generally planar second base portion 44, which may extend from first base portion 28 in a direction generally perpendicular to first base portion 28, shown as vertical direction 46.

First base portion 28 may be generally rectangular, and may have an inward surface 32 configured to be attached to tool 12. First base portion 28 may also have an outward surface 34 opposite inward surface 32. In addition, first base portion may have a pair of opposite sides 36, 38 that extend generally parallel to longitudinal direction 30. First base portion may also have a pair of opposite ends, first end 40 and second end 42, which extend in a direction generally perpendicular to longitudinal direction 30, shown as latitudinal direction 57.

Referring to FIGS. 4-7, first base portion 28 may define a first opening 60, which may be configured to receive a portion of wear member 16 and a retainer 24 (referring to FIG. 3). First opening 60 may extend along vertical direction 46 from outward surface 34, through first base portion 28, to inward surface 32. First opening 60 may be fully enclosed by first base portion 28. First opening 60 may include a notch-shaped portion 64 for receiving the portion of wear member 16, and a generally rectangle-shaped portion 62 contiguous with notch-shaped portion 64 for receiving retainer 24. It is contemplated that other shapes may be utilized for portion 62 of first opening 60. For example, portion 62 may be square-shaped, circle-shaped, oval-shaped, trapezoid-shaped, or otherwise-shaped. Regardless of its shape, portion 62 may be generally positioned in a central portion of first base portion 28 along longitudinal direction 30 of first base portion 28. Notch-shaped portion 64 may be positioned between rectangle-shaped portion 62 and first end 40.

Rectangle-shaped portion 62 of first opening 60 may have a surface 66 facing notch-shaped portion 64, and a pair of opposite ends 68, 70 that run parallel to longitudinal direction 30. Opposite ends 68, 70 may include a pair of opposing flanges 72, 74, which extend inward toward one another from lower regions of ends 68, 70, adjacent outward surface 34. Opposing flanges 72, 74 may be configured to facilitate retention of retainer 24 when retainer 24 is installed in rectangle-shaped portion 62 of first opening 60.

As used herein, "notch-shaped" is intended to cover an opening with a generally planar bottom surface and angled, generally planar side surfaces joining the bottom surface. Alternatively, the side surfaces may have some degree of curvature if desired. Notch-shaped portion 64 of first opening 60 may be defined by opposing angled surfaces 76, 78 that converge toward each other as they extend from inward surface 32 to outward surface 34. As a result of the convergence, a perimeter 77 of portion 64, which is defined by surfaces 76, 78, at inward surface 32 may be larger than a perimeter 75 of portion 64, which is defined by surfaces 76, 78, at outward surface 34. As shown, surfaces 76, 78 may be symmetrical about vertical direction 46. For example, both surfaces 76, 78 may extend at an angle of about 45 degrees relative to vertical direction 46. Alternatively, both surfaces 76, 78 may extend at another angle relative to vertical direction 46. Alternatively, surfaces 76, 78 may be asymmetrical about vertical direction 46, and may extend at different angles relative to vertical direction 46. In addition, notch-shaped portion 64 when viewed along an axis of first base portion 28 that is generally perpendicular to second base portion 44, may be generally isosceles trapezoid-shaped. Angled surfaces 76, 78 may at least partially define perimeters 77, 75 of notch-shaped portion 64 at inward surface 32 and outward surface 34, respectively. The notch-shaped portion 64 of first opening 60 may be configured such that a perimeter of the notch-shaped portion 64 is smaller at outward surface 34 than at inward surface 32.

First base portion 28 may also include a plurality of loading pads 86 configured to contact tool 12 and wear member 16, as shown in FIGS. 4-11. Loading pads 86 may be configured to transfer loads from wear member 16 to mounting base 22 and tool 12 in directions generally perpendicular to planar first base portion 28, generally perpendicular to planar second base portion 44, and generally parallel to both planar first base portion 28 and planar second base portion 44. Loading pads 86 may include protrusions of first base portion 28. The protrusions may be formed of raised portions of the surfaces surrounding first base portion 28. The protrusions may be generally plateau-shaped in that the raised portions of the first base portion 28 surfaces may extend out to a generally flat outer surface. The outer surfaces of loading pads 86 may constitute raised portions of inward surface 32, outward surface 34, sides 36, 38, and second end 42 depending on the surface they correspond (e.g., is generally parallel) with. For example, the outer surfaces of loading pads 86 that are generally parallel to inward surface 32 may constitute a portion of inward surface 32 and may be referred herein as inward surface 32. Loading pads 86 may be positioned at corners of first base portion 28 and may be configured to substantially surround at least a portion of the corners of first base portion 28. Loading pads 86 may be raised from their corresponding surfaces a distance of, for example, between about 0.5 millimeters to about 4 millimeters. Loading pads 86 raised from inward surface 32 and constituting a portion of inward surface 32 may be configured to contact first surface 18. Loading pads 86 raised from outward surface 34, sides 36, 38, and second end 42 may be configured to contact wear member 16 when wear member 16 is coupled to mounting base 22 (e.g., in the mounted position).

Second base portion 44 may extend from second end 42 of first base portion 28. Second base portion 44 may have an inward surface 48 configured to be attached to tool 12. Second base portion 44 may also have an outward surface 50 opposite inward surface 48. In addition, second base portion 44 may also have a pair of opposite sides 52, 54 that extend from first base portion 28. Second base portion 44 may also have a pair of opposite ends, lower end 56 and upper end 58, that extend in a direction generally perpendicular to longitudinal direction 30.

Figure 11:
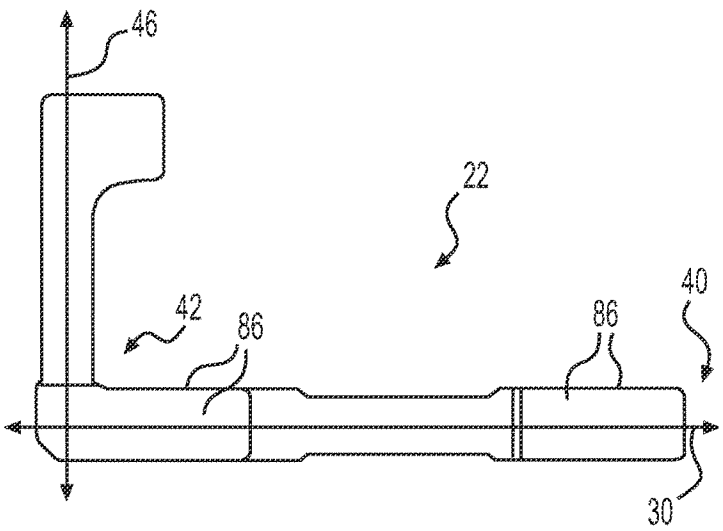
FIG. 11 is a left side view of the mounting base of FIGS. 4-10.

Second base portion 44 may also have a protrusion 59 that extends from upper end 58 in a direction generally parallel to first base portion 28. First base portion 28, second base portion 44, and protrusion 59 may form a generally L-shaped mounting base, as depicted in FIG. 11. As shown, the edges and corners of mounting base 22 may be radiused or rounded to reduce stress as depicted in FIGS. 4-11.

In some embodiments, mounting base 22 may be welded to tool 12. To facilitate such welding, a weld opening 80 may be formed in base 22 to receive weld material, and respective first end 40 and upper end 58 of base portions 28, 44 may include chamfered surfaces to receive weld material. For example, weld opening 80 may be generally oval-shaped, and may be formed in first base portion 28 between rectangle-shaped portion 62 of first opening 60 and second end 42. Alternatively, weld opening 80 may be otherwise-shaped, or may be formed in second base portion 44 or another part of first base portion 28. In yet another alternative, weld openings may be formed in both first and second base portions 28, 44.

At first end 40, first base portion 28 may have a first chamfer surface 82 configured to receive weld material for attaching first base portion 28 to first surface 18 of tool 12. First chamfer surface 82 may extend from an end of inward surface 32 away from tool 12 when inward surface 32 is attached to tool 12. First chamfer surface 82 may extend along first end 40 less than the full length of first end 40.

At upper end 58, second base portion 44 may have a second chamfer surface 84 configured to receive weld material for attaching second base portion 44 to second surface 20 of tool 12. Second chamfer surface 84 may extend from an end of inward surface 48 away from tool 12 when inward surface 48 is attached to tool 12. As shown, second chamfer surface 84 may be positioned at an end of protrusion 59. Second chamfer surface 84 may extend along upper end 58 less than the full length of upper end 58. Weld opening 80, first chamfer surface 82, and second chamfer surface 84 in combination may enable welding of mounting base 22 to tool 12 at three locations.

Referring to FIGS. 4-5 and 8-9, sides 52, 54 of second base portion 44 may be configured to be set in from sides 36, 38 of first base portion 28. Sides 52, 54 may also be configured to converge toward each other as they extend away from first base portion 28. As shown, sides 52, 54 may be symmetrical about vertical direction 46. For example, both sides 52, 54 may extend at an angle $\alpha$ of about 3 degrees relative to vertical direction 46. In other words, second base portion 44 along latitudinal direction 57 at upper end 58 may be narrower than second base portion 44 at lower end 56. The transition of inward surface 32 to sides 52, 54 at second end 42 and lower end 56 may be radiused to reduce stress as depicted in FIGS. 4-5 and 8-9

Figure 9:
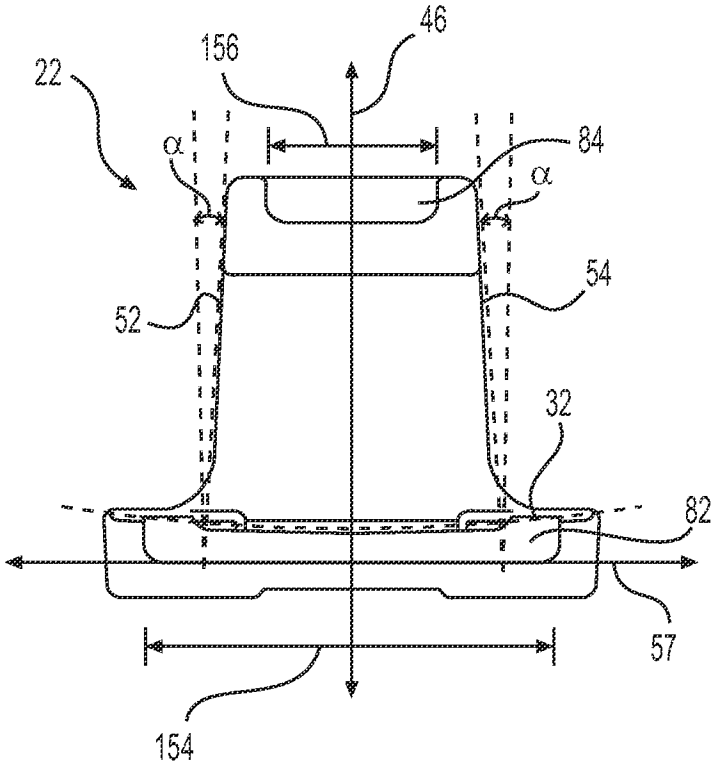
FIG. 9 is a front view of the mounting base of FIGS. 4-8.
Figure 12:
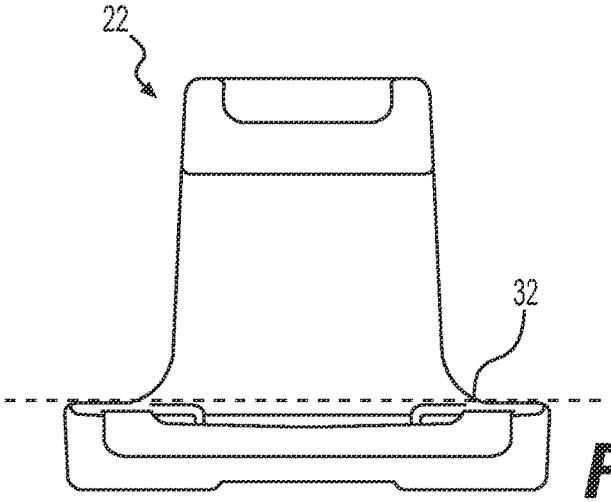
FIG. 12 is a front view of another exemplary disclosed mounting base of one of the wear member systems of FIGS. 1 and 2.

According to one embodiment, as shown in FIGS. 4-11, and as best shown in FIG. 9, inward surface 32 of first base portion 28 including the outer surfaces of loading pads 86 that constitute a portion of inward surface 32, may be concave having a radius of curvature. The radius of curvature of inward surface 32 including the outer surfaces of loading pads 86 that constitute a portion of inward surface 32 may generally correspond with the radius of curvature of first surface 18 at heels 15, 17 of tool 12. The corresponding radius of curvatures of the two surfaces may facilitate a flush mating of the outer surfaces of loading pads 86 that constitute a portion of inward surface 32 and first surface 18. Concave inward surface 32 may have a radius of curvature of between about 400 millimeters and about 800 millimeters. In some embodiments the radius of curvature may be between about 500 millimeters and about 700 millimeters. For example, the radius of curvature may be about 600 millimeters. It is contemplated that other radius of curvatures may be utilized. In another embodiment, as shown in FIG. 12, inward surface 32 of first base portion 28 may be substantially flat. Mounting base 22 having a flat inward surface 32 may be used at first surface 18 of tool 12 where first surface 18 is correspondingly flat to facilitate a flush mating of the surfaces. Besides the difference in the radius of curvature of inward surface 32, mounting base 22 shown in FIG. 12 may otherwise be identical to mounting base 22 shown in FIGS. 4-11.

Figure 8:
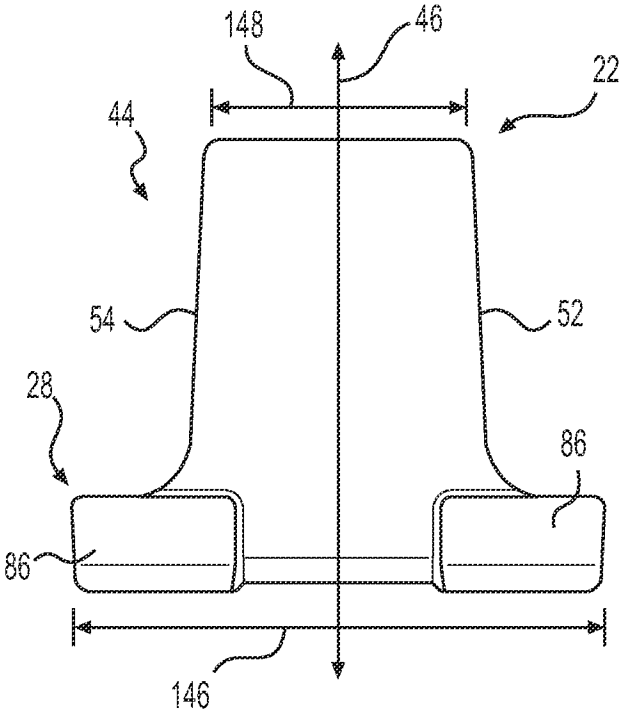
FIG. 8 is a back view of the mounting base of FIGS. 4-7.

Mounting base 22 may vary in size thus enabling mounting base 22 to fit a variety of different sizes of tool 12. Although the size of mounting base 22 may vary in size, the ratio of various dimensions may remain generally the same regardless of the variation in the overall size of mounting base 22 and correspondingly wear member system 14. Referring to FIG. 8, a ratio of a maximum width 146 of first base portion 28 to a maximum width 148 of second base portion 44 at upper end 58, along a direction parallel to both the first base portion 28 and second base portion 44, may be between about 1.5 and about 2.5. In some embodiments, the ratio may be between about 1.75 and about 2.25. For example, the ratio may be about 2. This range of ratios may be beneficial because having second base portion 44 smaller than first base portion 28 may reduce the weight and cost of mounting base 22. However, second base portion 44 must be sufficiently large to maintain the overall structural integrity of mounting base 22.

Figure 10:
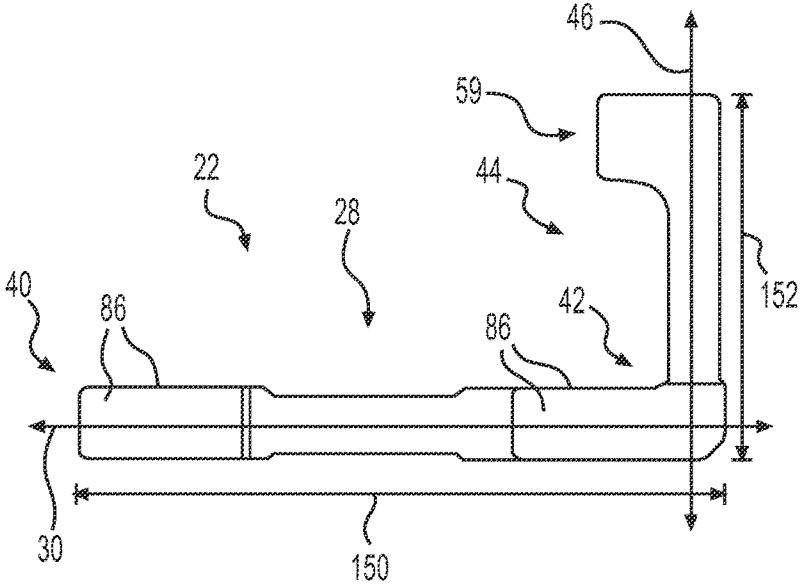
FIG. 10 is a right side view of the mounting base of FIGS. 4-9.

Referring to FIG. 10, a ratio of a maximum length 150 of first base portion 28, along a direction generally perpendicular to second base portion 44, to a maximum height 152 of second base portion 44, along a direction generally perpendicular to first base portion 28 may be between about 1.5 and about 2.0. In some embodiments, the ratio may be between about 1.7 and about 1.8. In some other embodiments, the ratio may be between about 1.75 and about 1.78. For example, the ratio may be about 1.77. This range of ratios may be beneficial because it may provide a suitable size mounting base 22 relative to the tool 12 size while not being so large and heavy that installation and replacement of wear member 16 becomes problematic.

Referring to FIG. 9, a ratio of a width 154 of first chamfer surface 82 to a width 156 of second chamfer surface 84, along a direction parallel to both the first base portion 28 and second base portion 44, may be between about 2.0 and about 3.0. In some embodiments, the ratio may be between about 2.25 and about 2.75. For example, the ratio may be about 2.5. Maximizing the length of the chamfer surfaces may be beneficial in order to ensure mounting base 22 is adequately secured to tool 12.

FIGS. 13-20 illustrate an exemplary wear member 16 from a variety of angles. As shown, wear member 16 may include a generally planar first wear member portion 88 that extends in longitudinal direction 30. Wear member 16 may also include a generally planar second wear member portion 90, which may extend from first wear member portion 88 in a direction generally perpendicular to first wear member portion 88.

First wear member portion 88 may be generally rectangular, and may have a first inward surface 89. First wear member portion 88 may also have a wear surface 94 opposite inward surface 89. As shown, a thickness of first wear member portion 88, in a direction parallel to the direction in which second wear member portion 90 extends, may decrease as first wear member portion 88 extends from second wear member portion 90. First wear member portion 88 may define a second opening 102, which may be configured for pass-through of retainer 24 (referring to FIG. 3). Second opening 102 may extend along vertical direction 46 from wear surface 94, through first wear member portion 88, to inward surface 89. In addition, second opening 102 may be generally rectangle-shaped.

As shown in FIGS. 13-14 and 16-17, wear surface 94 may be convex and have a radius of curvature. The radius of curvature of wear surface 94 may generally correspond with the radius of curvature of first surface 18 at heels 15, 17 of tool 12. The convex wear surface 94 may have a radius of curvature between about 500 millimeters and about 800 millimeters. In some embodiments, the radius of curvature may be between about 600 millimeters and about 700 millimeters. In some other embodiments, the radius of curvature may be between about 650 millimeters and about 660 millimeters. For example, the radius of curvature may be about 655 millimeters.

Second wear member portion 90 may be generally rectangular, and may have a second inward surface 91 contiguous with first inward surface 89 of first wear member portion 88. First inward surface 89 and second inward surface 91 of wear member 16 may define a receiving pocket 96 configured to receive mounting base 22. Receiving pocket 96 may be a generally rectangle-shaped recessed cavity within first wear member portion 88 and second wear member portion 90. As shown, a width of receiving pocket 96 may be less than a width of wear member 16. First wear member portion 88 may include a portion of receiving pocket 96 configured to receive first base portion 28, and second wear member portion 90 may include a portion of receiving pocket 96 configured to receive second base portion 44. The portion of receiving pocket 96 defined by first wear member portion 88 may be open at first end 92, opposite second wear member portion 90. In other words, looking along a longitudinal direction, receiving pocket 96 may be open at first end 92 of first wear member portion 88.

Figure 18:
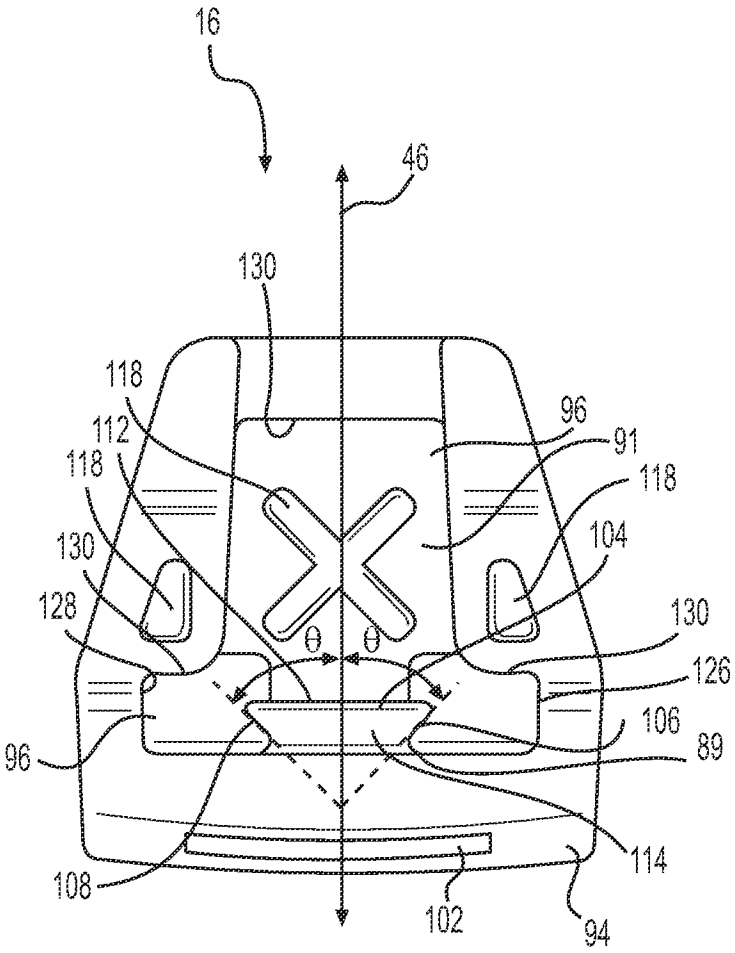
FIG. 18 is a front view of the wear member of FIGS. 13-17.

First inward surface 89 of first wear member portion 88 may define a projection 104 adjacent to second opening 102 configured for removably coupling wear member 16 to mounting base 22 when attached to tool 12. Projection 104 may be positioned between second opening 102 and first end 92 of wear member 16. Projection 104 may have opposite engagement surfaces 106, 108 that may diverge from each other as they extend away from first inward surface 89 within receiving pocket 96 to an upper surface 112 of projection 104. As shown in FIG. 18, engagement surfaces 106, 108 may be symmetrical about vertical direction 46. For example, engagement surfaces 106, 108 may extend away from first inward surface 89 at angles θ relative to vertical direction 46, for example of about 45 degrees. Projection 104, when viewed along an axis of first wear member portion 88 generally perpendicular to second wear member portion 90, may be generally isosceles trapezoid-shaped. As shown, the joint between each engagement surface 106, 108 and first inward surface 89 may be rounded to reduce stress within projection 104 and first wear member portion 88. The other joints, edges, and corners of wear member 16 may also be radiused or rounded to reduce stress as depicted in FIGS. 13-20.

Projection 104 may also have a front surface 114 and a back surface 116 extending from first inward surface 89 to upper surface 112. Front surface 114 and back surface 116 may be generally perpendicular to first inward surface 89. Projection 104 may be configured to form a dovetail like joint with the notch-shaped portion 64 of first opening 60. In addition, projection 104 may be configured such that a height of projection 104 may be less than a depth of receiving pocket 96 so that projection 104 may be positioned completely within receiving pocket 96. In other words, projection 104 may be configured such that no part of projection 104 extends beyond the boundaries of receiving pocket 96.

Figure 17:
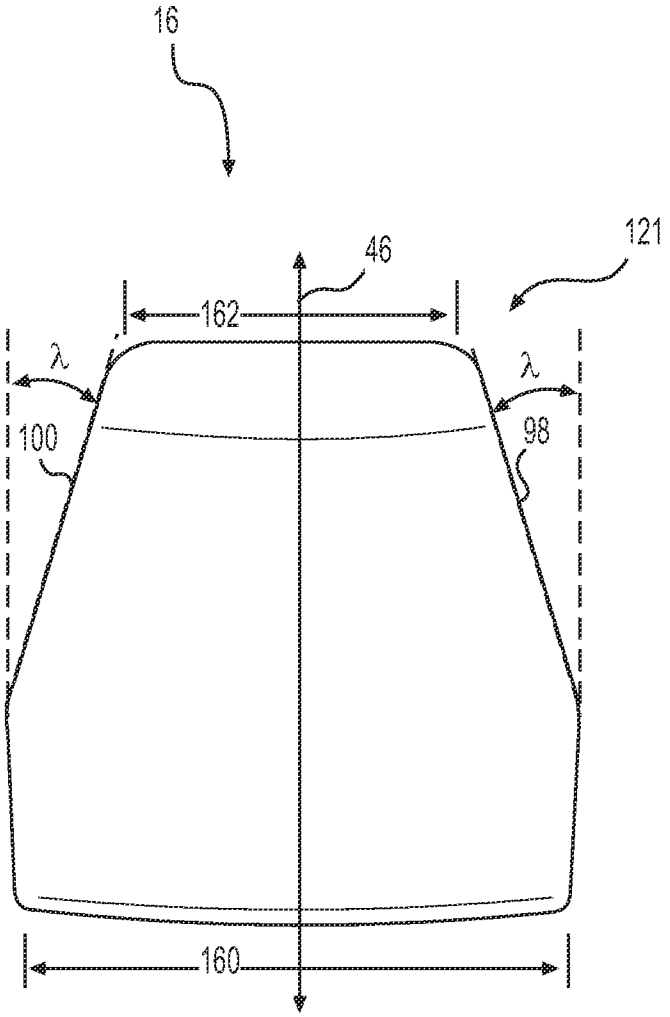
FIG. 17 is a back view of the wear member of FIGS. 13-16.
Figure 20:
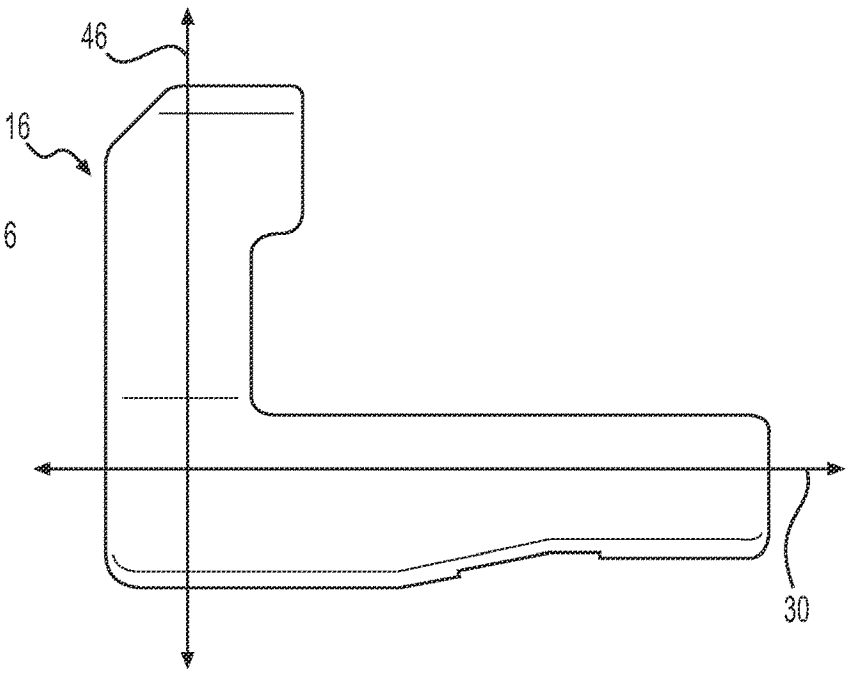
FIG. 20 is a left side view of the wear member of FIGS. 13-19.

Referring to FIGS. 13-14 and 17-18, second wear member portion 90 may have opposite side surfaces 98, 100 that extend from first wear member portion 88. Side surfaces 98, 100 initially diverge away from one another and then pivot and converge towards one another as they extend from first wear member portion 88. As shown in FIG. 17, the converging portions of side surfaces 98, 100 may extend at angles λ relative to vertical direction 46. Angle λ may be between about 15 degree and about 18 degrees. In some embodiments, angle λ may be between about 16 degrees and about 17 degrees. For example, angle λ may be about 16.75 degrees. It is also contemplated that, in other embodiments, other angles λ may be utilized or side surfaces 98, 100 may be parallel.

Wear member 16 may also define one or more wear indicators 118. The wear indicators may be configured to provide an indication as to when wear member 16 should be replaced with a new wear member 16. The indication as to when wear member 16 should be replaced may be, for example when a sufficient portion of the material of wear member 16 is worn off thereby revealing mounting base 22 through one or more of wear indicators 118. In other words, when mounting base 22 becomes visible through wear member 16 at the location of one wear indicator 118, this may act as the indication that wear member 16 should be replaced.

First wear member portion 88 may define a wear indicator 118 formed on inward surface 89 within receiving pocket 96 between rectangle-shaped second opening 102 and a second end 120. Wear indicator 118 may comprise a recess that is recessed into first wear member portion 88 from first inward surface 89 away from receiving pocket 96. Second wear member portion 90 may also define a wear indicator 118 formed on second inward surface 91 in a central region of second wear member portion 90. Wear indicator 118 formed on second inward surface 91 may comprise a recess that is recessed into second inward surface 91 away from receiving pocket 96. By recessing wear indicators 118 away from receiving pocket 96, the indication that wear member 16 should be replaced may occur prior to any wearing of mounting base 22 occurring. The recessed depth of wear indicators 118 from first inward surface 89 within receiving pocket 96 may be between about 1 millimeter and about 5 millimeters. In other embodiments, the depth may be between about 2 millimeters and about 4 millimeters. For example, the depth may be about 3 millimeters.

Figure 13:
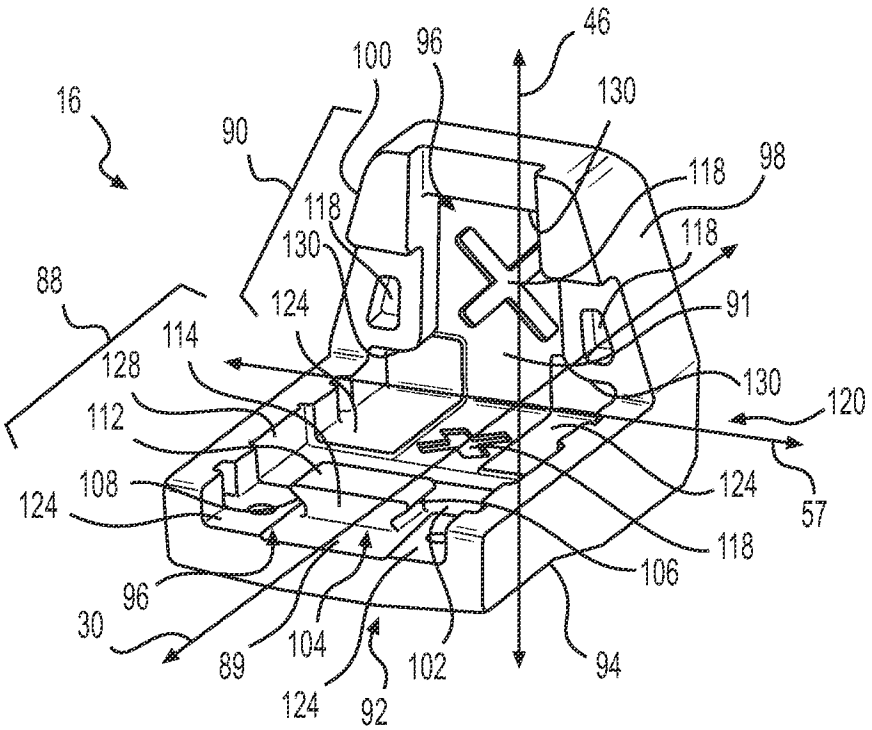
FIG. 13 is a perspective view of an exemplary disclosed wear member of the wear member system of FIG. 3.
Figure 16:
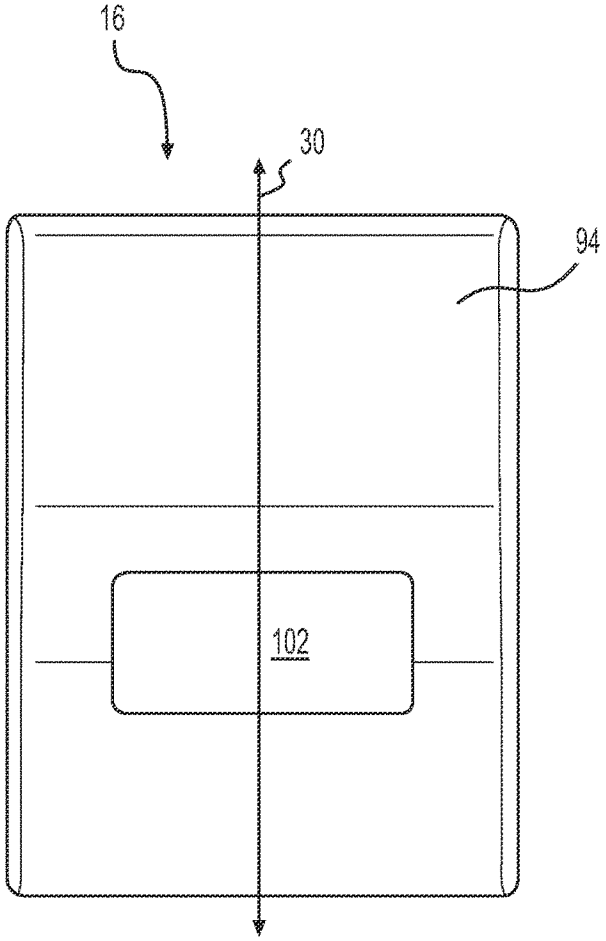
FIG. 16 is a bottom view of the wear member of FIGS. 13-15.
Figure 15:
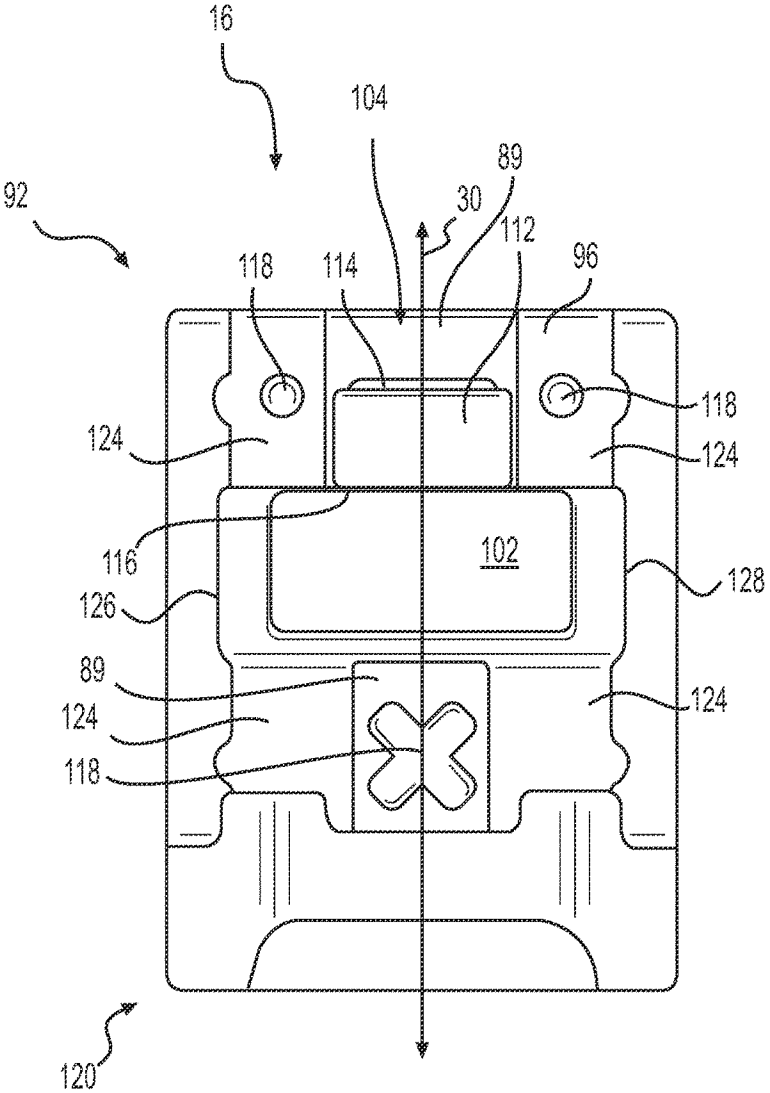
FIG. 15 is a top view of the wear member of FIGS. 13-14.

As shown in FIGS. 13, 15, and 18, wear indicators 118 defined by wear member 16 may be an "X" shaped recess. It is contemplated that other recess shapes may be utilized. It is also contemplated that additional wear indicators 118 may be formed in wear member 16. For example, as shown in FIG. 15, first wear member portion 88 may also define circular shaped recess wear indicators 118 positioned between rectangle-shaped second opening 102 and first end 92 on either side of receiving pocket 96. In yet another example, as shown in FIGS. 13 and 18, second wear member portion 90 may also define additional wear indicators 118 defined outside of receiving pocket 96. These additional wear indicators may be any of a variety of shapes, for example, a square, a circle, a triangle, a quadrilateral, or other shape. These wear indicators 118 formed outside of receiving pocket 96 may have a recessed depth greater than that of the other wear indicators 118.

Figure 14:
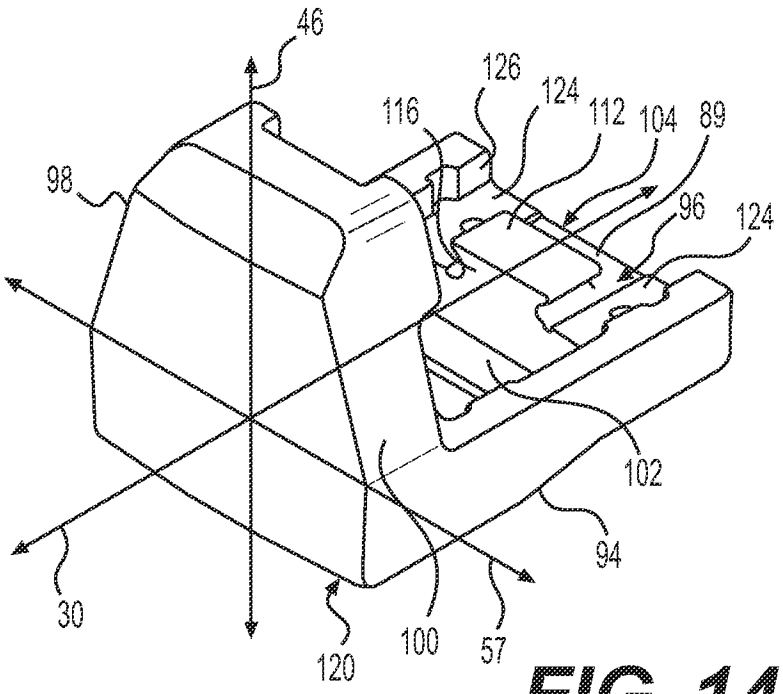
FIG. 14 is another perspective view of the wear member of FIG. 13, from a different angle.

Referring to FIGS. 13-15, wear member 16 may also include a plurality of loading pads 124 configured to contact mounting base 22. Loading pads 124 may be configured to transfer loads from wear member 16 to mounting base 22 in directions generally perpendicular to first wear member portion 88, generally perpendicular to second wear member portion 90, and generally parallel to both first wear member portion 88 and second wear member portion 90. Loading pads 124 may include protrusions within receiving pocket 96. The protrusions may be formed of raised portions of receiving pocket 96 surfaces. Receiving pocket 96 surfaces may include first inward surface 89, side walls 126, 128, and second inward surface 91. The protrusions may be generally plateau-shaped. Loading pads 124 may be positioned at corners of receiving pocket 96. Loading pads 124 may be configured to correspond and contact loading pads 86 of mounting base 22. All loading pads 124 raised from first inward surface 89 may be substantially level. All the loading pads 124 raised from second inward surface 91 may be substantially level. All the loading pads 124 raised on each individual side wall 126, 128 may be substantially level.

Second wear member portion 90 may also have one or more loading surfaces 130 formed by side walls of receiving pocket 96, as depicted in FIGS. 13 and 18. Loading surfaces 130 may extend out from second inward surface 91 parallel to first wear member portion 88 over the portion of receiving pocket 96 defined by first wear member portion 88. Loading surfaces 130 are configured to contact loading pads 86 of first base portion 28 and upper end 58 of second base portion 44 when mounting base 22 is coupled to wear member 16. Loading surfaces 130 may be configured to transfer loads onto mounting base 22 that are perpendicular to first wear member portion 88.

As shown in FIG. 3, wear member 16 may be wider than mounting base 22 along latitudinal direction 57, longer than mounting base 22 along longitudinal direction 30, and taller than mounting base along vertical direction 46. In other words, wear member 16 may be configured such that it may substantially surround mounting base 22 when coupled together in a mounted positioned as demonstrated in FIG. 3.

Wear member 16 may vary in size thus enabling wear member 16 to fit a variety of different sizes of tool 12. Although the size of wear member 16 may vary, the ratio of various dimensions may remain generally the same regardless of the variation in the overall size of wear member 16 and corresponding wear member system 14.

Referring to FIG. 17, a ratio of a maximum width 160 of first wear member portion 88 to a maximum width 162 of second wear member portion 90 at an upper end 121, along a direction parallel to both the first wear member portion 88 and second wear member portion 90, may be between about 1 and about 2. In some embodiments, the ratio may be between about 1.25 and about 1.75. In some other embodiments, the ratio may be between about 1.5 and about 1.6. For example, the ratio may be about 1.55. The ratio of the widths may correlate with angle $\lambda$ of converging side surfaces 98, 100 of second wear member portion 90. As a result of the converging sides and ratio of the widths, wear member systems 14 may be mounted in closer proximity to one another along the heel of the tool without having interference issues as illustrated in FIG. 2.

Figure 19:
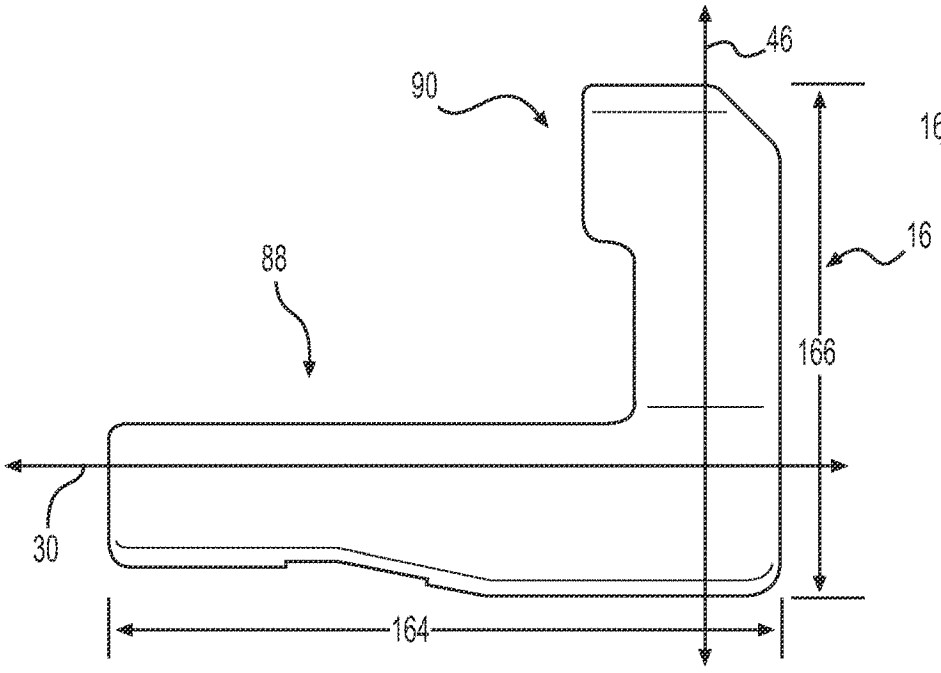
FIG. 19 is a right side view of the wear member of FIGS. 13-18.

Referring to FIG. 19, a ratio of a maximum length 164 of first wear member portion 88, along a direction generally perpendicular to second wear member portion 90, to a maximum height 166 of second wear member portion 90, along a direction generally perpendicular to first wear member portion 88, may be between about 1.15 and about 1.5. In some embodiments, the ratio may be between about 1.3 and about 1.35. For example, the ratio may be about 1.32. This ratio may correlate with the corresponding maximum length and maximum height ratio of mounting base 22. This range of ratios may be beneficial because they may provide a suitable size wear member 16 relative to the size of tool 12, while not being so large and heavy that installation and replacement of wear member 16 becomes problematic.

The dimensions of the mounting base 22 relative to wear member 16 may also remain generally the same regardless of the variation in the overall size of wear member system 14. For example, referring to FIGS. 8 and 17, a ratio of width 160 of first wear member portion to width 146 of first base portion 28 may be between about 1.15 and about 1.5. In some embodiments the ratio may be between about 1.3 and about 1.35, for example, about 1.32. Referring again to FIGS. 8 and 17, a ratio of width 162 of second wear member portion 90 to width 148 of second base portion 44 may be between about 1.55 and about 1.8. In some embodiments, the ratio may be between about 1.65 and about 1.70, for example, about 1.68. Referring to FIGS. 10 and 19, a ratio of length 164 of first wear member portion 88 to length 150 of first base portion 28 may be between about 1.0 and about 1.4. In some embodiments, the ratio may be between about 1.1 and about 1.3, for example about 1.20. These ratios of wear member 16 to mounting base 22 may be beneficial in order to ensure the size of both mounting base 22 and wear member 16 may be suitable based on the size of tool 12. In addition, these ratios may provide an appropriate amount of material surrounding mounting base 22 so that the life expectancy of wear member 16 may be sufficiently long.

Figure 21:
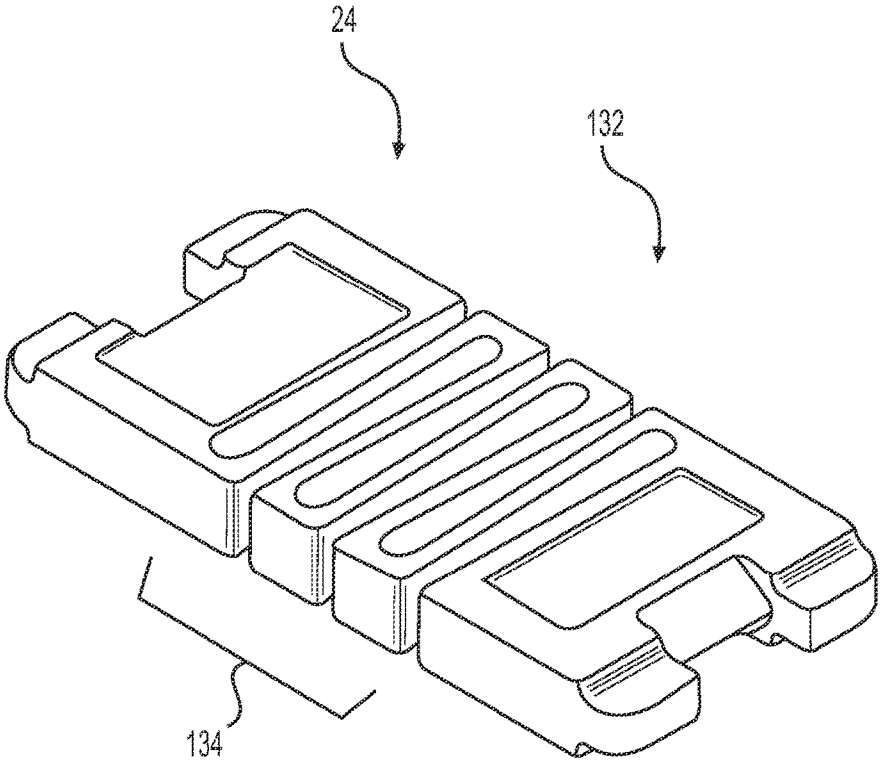
FIG. 21 is a perspective view of an exemplary disclosed retainer of the wear member system of FIG. 3.

Referring to FIGS. 3 and 21, retainer 24, may have a generally flat rectangular shaped body portion 132 which may be adapted for placement within the rectangle-shaped portion 62 of first opening 60. Retainer 24 may be configured such that when installed within rectangle-shaped portion 62 of first opening 60, it may maintain wear member 16 in the mounted position on mounting base 22. The body may be constructed of steel, or any suitable substantially non-compressible material. Retainer 24 may also be provided with a spring portion 134 along body 132, which may be adapted to provide body 132 with sufficient resiliency from end to end to permit the length of body 132 to be compressed when a compressive force is applied to the ends, but be sufficiently rigid from side to side to enable retainer 24 to withstand compressive loads applied to the sides without incurring any significant distortion. It is contemplated that other retainer designs may be utilized to maintain the mounted position of wear member 16. For example, first opening 60 and retainer 24 may comprise other shapes besides a rectangle-shape.

Figure 22:
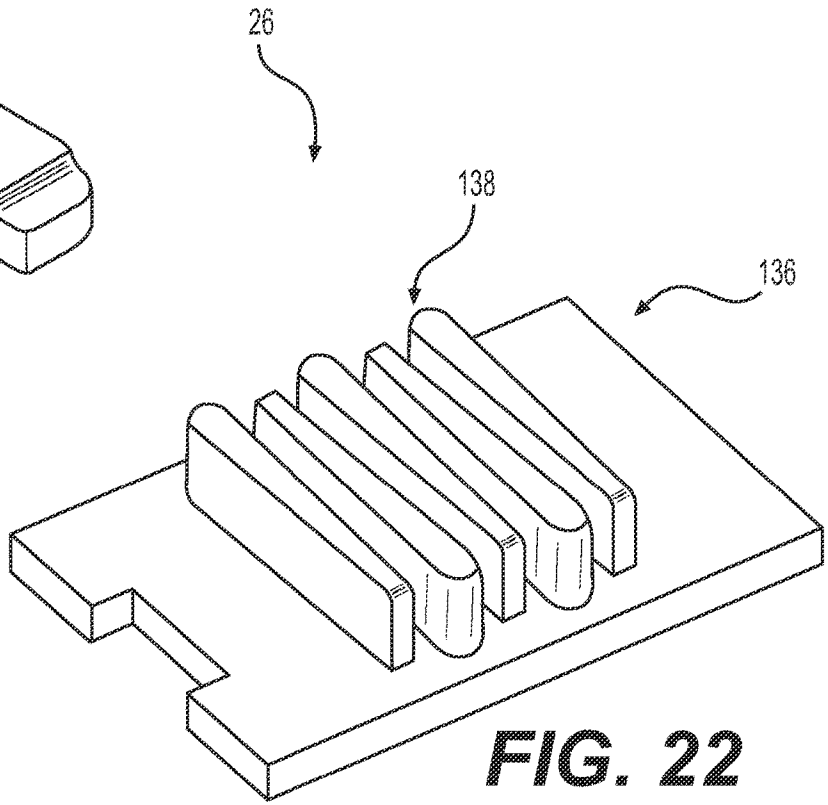
FIG. 22 is a perspective view of an exemplary disclosed plug of the wear member system of FIG. 3.

FIG. 22 shows one embodiment of plug 26. Plug 26 may have a flat base 136 and a plurality of projections 138 that correspond in shape to spring portion 134 of retainer 24, thereby enabling projections 138 of plug 26 to be inserted into spring portion 134 of retainer 24. Plug 26 when inserted into retainer 24 may prevent earthen material from getting lodged in spring portion 134. Without plug 26, earthen material may get lodged in spring portion 134, thus restricting compression of spring portion 134 and making for difficult removal of retainer 24.

Figure 28:
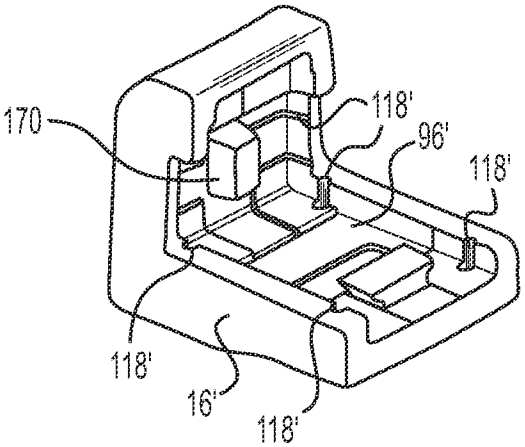
FIG. 28 is a perspective view of an exemplary disclosed wear member of the wear member system of FIG. 26.
Figure 27:
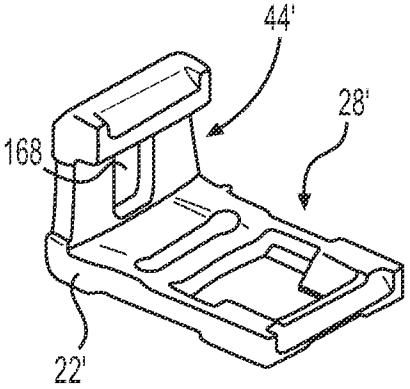
FIG. 27 is a perspective view of an exemplary disclosed mounting base of the wear member system of FIG. 26.
Figure 26:
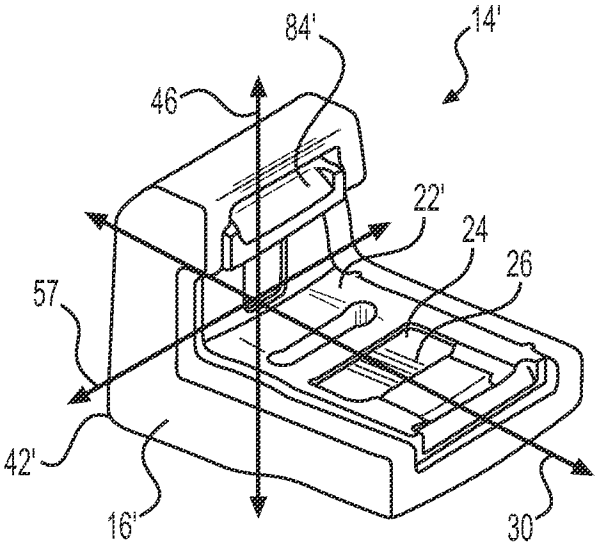
FIG. 26 is a perspective view of another exemplary disclosed wear member system.

Another embodiment of a wear member system is shown in FIGS. 26-28. Wear member system 14' may be substantially similar to wear member system 14. For example, wear member system 14' may include a wear member 16', a mounting base 22', retainer 24, and plug 26. Mounting base 22' may be configured to attach (e.g., fixedly) to first surface 18 and second surface 20 of tool 12. Wear member 16' may be configured to removably couple to mounting base 22'. Retainer 24 may be configured to keep wear member 16 coupled to mounting base 22, and plug 26 may be configured to protect retainer 24.

As shown in FIGS. 26-28, mounting base 22' may be similar in many respects to mounting base 22. However, there are noticeable differences between the embodiments. For example, a second base portion 44' of mounting base 22' may be generally the same width as a first base portion 28' at second end 42', whereas second base portion 44 is narrower than first base portion 28 at second end 42. As a result of the increased width of second base portion 44' relative to first base portion 28, a width of second chamfer surface 84' may also be increased. The shape of receiving pocket 96' defined by wear member 16' may be correspondingly shaped in order to receive the wider second base portion 44' of mounting base 22'.

Another difference between the embodiments includes, for example, how second base portion 44' may define a tab opening 168 configured to receive a tab 170 defined by wear member 16'. Wear member 16 and mounting base 22 have neither tab opening 168 nor tab 170. As shown in FIG. 26, tab opening 168 may be configured to receive tab 170 through second base portion 44'. The surfaces of tab 170 may be configured to contact the corresponding surfaces of tab opening 168 when wear member 16' is coupled to mounting base 22'. The surfaces of tab opening 168 and tab 170 may be configured to function similarly to loading surface 130 of wear member system 14. In other words, tab 170 may be configured to transfer loads applied to wear member 16' to mounting base 22' via tab opening 168. The loads transferred by tab opening 168 and tab 170 may be applied to wear member 16' along vertical direction 46 and latitudinal direction 57 to mounting base 22'.

Yet another example of a difference between wear member system 14 and 14' includes the difference between the wear indicators 118 of wear member 16 and wear indicators 118' of wear member 16'. Wear member 16' may include circular wear indicators 118' formed along the side walls of receiving pocket 96', in contrast to wear indicators 118, which as described herein, may be both circular and "X" shaped and positioned within receiving pocket 96. Additional minor differences between wear member system 14 and 14' may be identifiable from the figures.

INDUSTRIAL APPLICABILITY

The disclosed wear member systems may be applicable to any tool that has a heel with first and second surfaces that are generally perpendicular. The wear member system may have various advantages over prior art wear member systems. For example, they may be relatively easy to remove/and or install regardless of tool size. In addition, a first and second surface of a tool may be protected using a single mounting base and wear member system. Yet another advantage may be serviceability based on the multiple surface wear indicators, which may provide an indication of when the wear member should be replaced.

Figure 25:
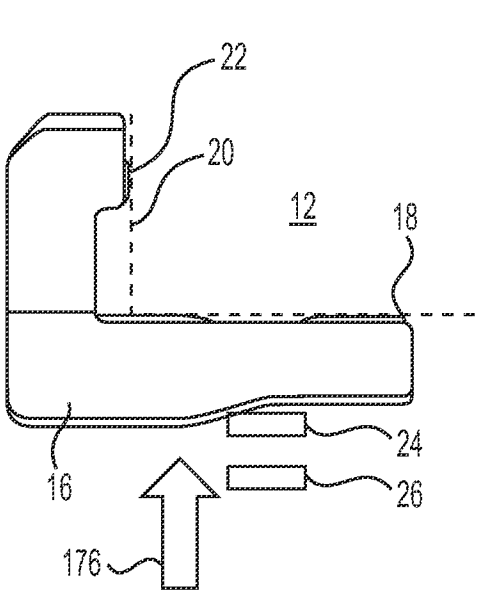
FIGS. 23, 24, and 25 are side views of the wear member system of FIG. 3 in various states of assembly.
Figure 24:
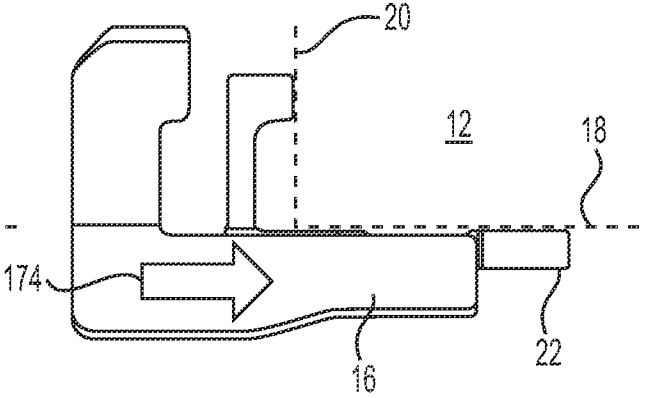
Figure 23:
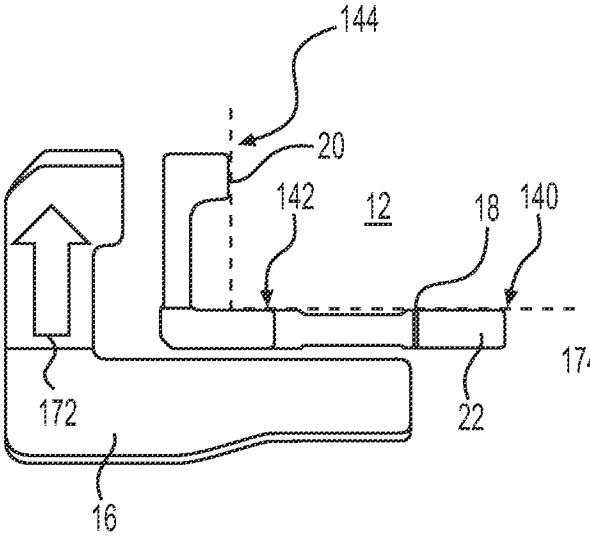

Wear member 16 and mounting base 22 provide a quick and simple system for mounting and removing wear member 16 onto and from mounting base 22. The mounting and removal of wear member 16 may be accomplished without special tools, requiring only a common pry bar. FIGS. 23-25 depict the mounting wear member 16 and mounting base 22 in various states of assembly. As described herein, mounting base 22 may be attached to tool 12 via welding. Mounting base 22 may be welded to tool 12 at a first location 140 and a second location 142 along first surface 18, and at a third location 144 along second surface 20. Once mounting base 22 is attached to tool 12, wear member 16 may be coupled to mounting base 22 by movement of wear member 16 in a first direction toward mounting base 22, as shown by arrow 172 in FIG. 23. Projection 104 of wear member 16 should be substantially aligned with the rectangle-shaped portion 62 of first opening 60 in order to allow insertion of projection 104 into first opening 60.

As shown in FIG. 24, wear member 16 may first be positioned on mounting base 22 in an offset position where projection 104 may be in inserted within rectangle-shaped portion 62 of first opening 60 to the left of notch-shaped portion 64. Wear member 16 may then be slid to the right in a second direction, as shown by arrow 174, into a mounted position. As wear member 16 is slid to the right, projection 104 may move from rectangle-shaped portion 62 of first opening 60 into notch-shaped portion 64 thereby engaging engagement surfaces 106, 108 of projection 104 with angled surfaces 76, 78 of notch-shaped portion 64 into an opposing interlocking relationship with each other. The mating of engagement surfaces 106, 108 and angled surfaces 76, 78 may form a dovetail like joint.

In the mounted position, rectangle-shaped portion 62 of first opening 60 may be brought in alignment with rectangle-shaped second opening 102 enabling insertion of retainer 24 through wear member 16 into position within rectangle-shaped portion 62 of first opening 60, as shown in FIG. 25. Retainer 24 may be inserted into rectangle-shaped portion 62 of first opening 60 in a third direction, as shown by arrow 176. With one end of retainer 24 being positioned in first opening 60 under one of the flanges 72, 74, a pry bar may be inserted at the other end of retainer 24. By applying a reasonable force to retainer 24 with the screw driver, retainer 24 may be sufficiently compressed in length to move the free end of the retainer 24 past the other flange and seat retainer 24 fully within rectangle-shaped portion 62 of first opening 60. When installed, retainer 24 may prevent movement, in the longitudinal direction 30 of wear member 16, relative to mounting base 22. Retainer 24 may prevent movement by maintaining the position of projection 104 within notch-shaped portion 64 of first opening 60. Following the installation of retainer 24, plug 26 may also be installed by insertion through rectangle-shaped second opening 102 in wear member 16.

Wear member 16 may be uncoupled from mounting base 22 by performing the above steps in reverse. For example, first plug 26 (if installed) may be removed. Next, retainer 24 may be removed and then wear member 16 may be slid to the left until projection 104 is aligned with rectangle-shaped portion 62 of first opening 60. Once projection 104 is aligned, wear member 16 may be dropped away from mounting base 22. A new wear member 16 may then be installed.

Another advantage of wear member system 14 is versatility. Wear member system 14 may protect a portion of both first surface 18 and second surface 20 of tool 12 at heel 15 or 17 utilizing just a single wear member 16. In contrast, single surface wear members often require two separate mounting bases and wear members, one for first surface 18 and one for second surface 20, in order to protect each heel section of the tool. Thus, wear member system 14 may reduce installation time and cost by protecting both surfaces with one wear member and one mounting base.

Yet another advantage of wear member system 14 and wear member 16 may be the one or more wear indicators 118 that may provide an indication of when wear member 16 should be replaced. In some applications, wear member 16 may experience different amounts of wear depending on the surface of wear member 16. As a result, it may be beneficial to have wear indicators 118 formed on multiple surfaces of wear member 16 and in multiple locations on the surfaces to provide wear indication at multiple locations. In some applications, it may be beneficial to periodically rotate the position of wear members 16 on tool 12 in order to achieve even wearing of wear members 16 and increase the usable life of each wear member.

Figure 29:
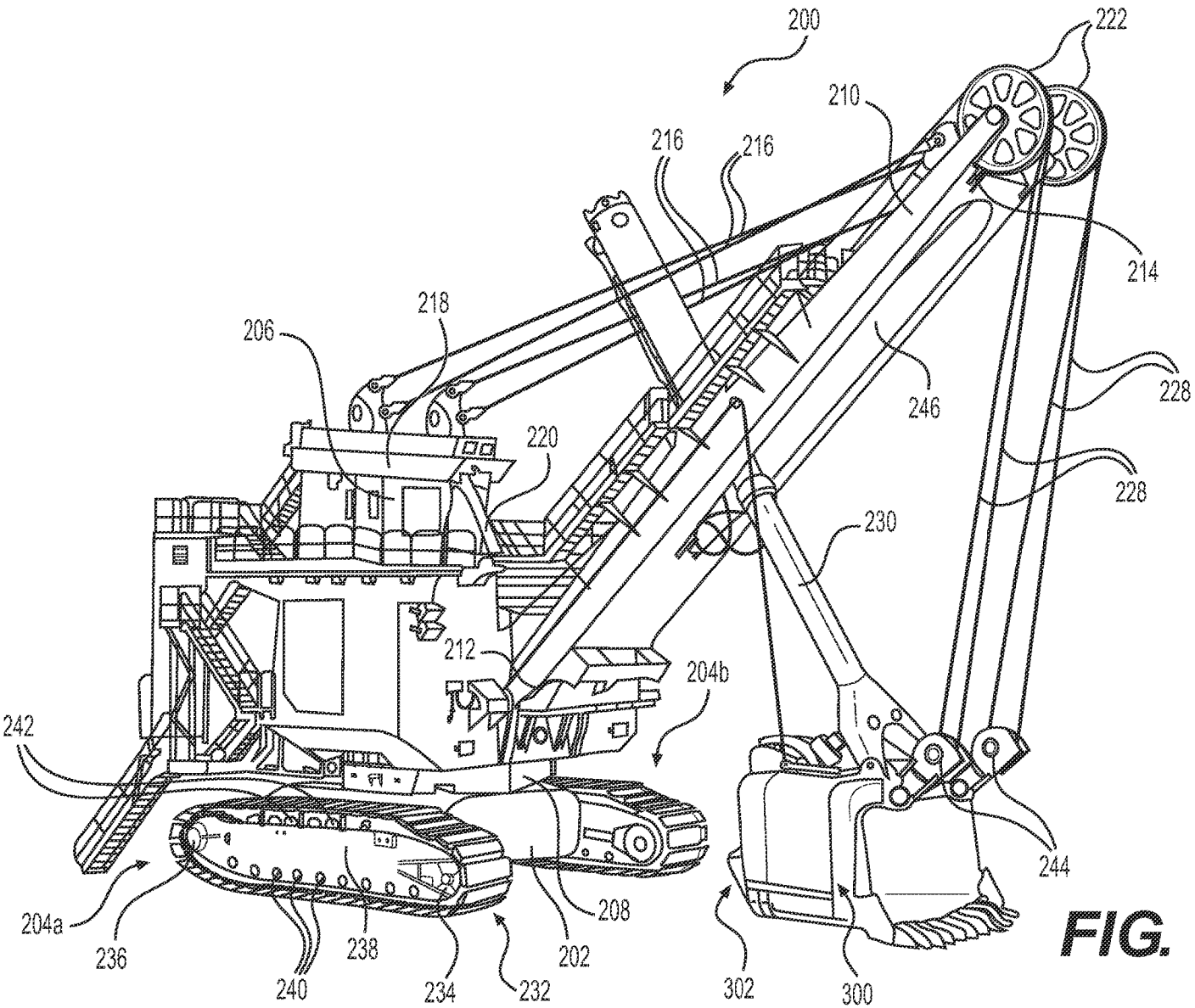
FIG. 29 illustrates a machine that may use a work tool such a dipper having wear members, wear member systems, and mounting bases configured according to various embodiments of the present disclosure.
Figure 30:
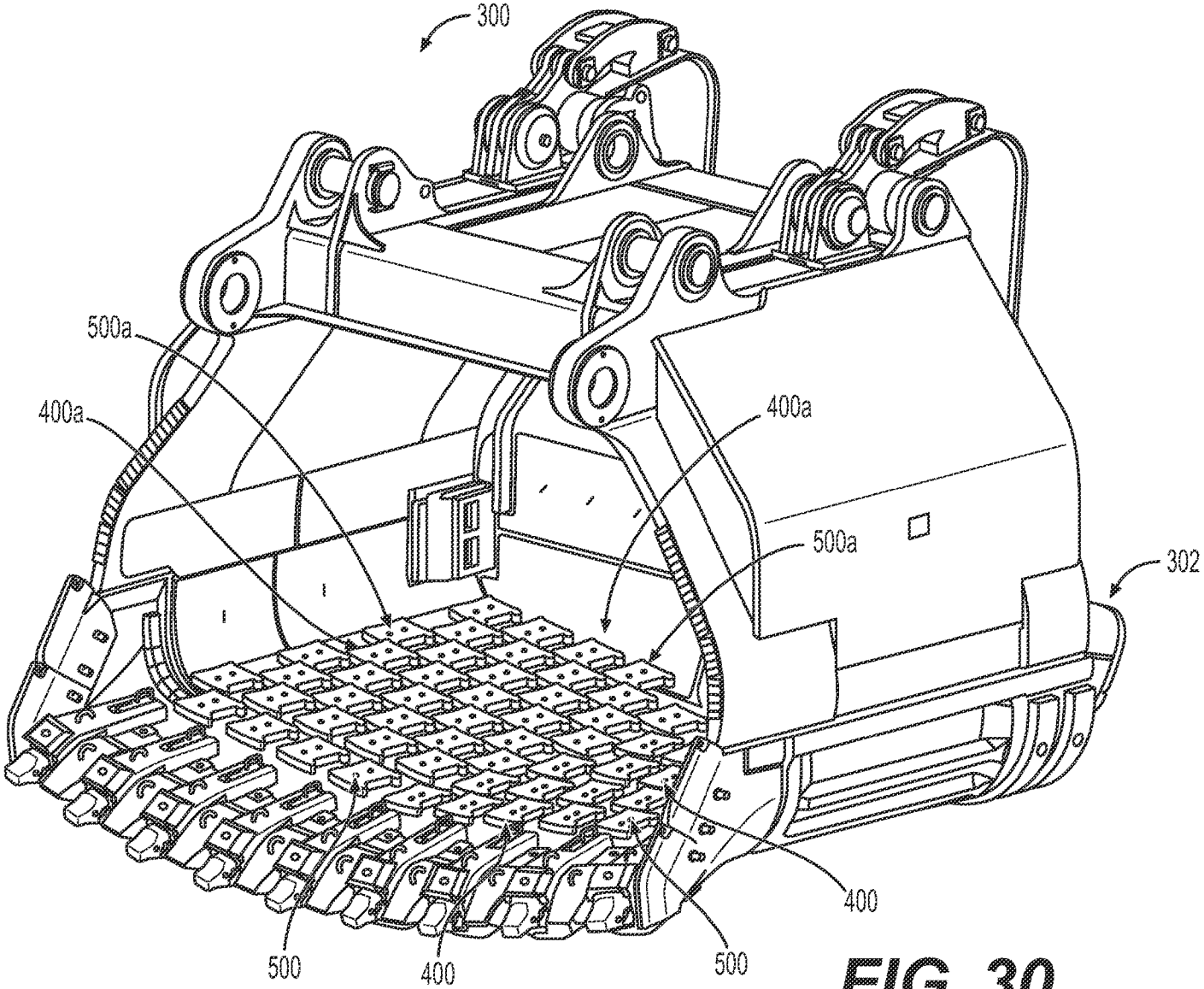
FIG. 30 is a perspective view of work tool in the form of a dipper than has a plurality of wear members according to various embodiments of the present disclosure that are attached to its interior bottom surface.

Referring to FIGS. 29 and 30, there is shown a machine 200 (e.g., an electric rope shovel with a dipper that may use any of the embodiments discussed herein) having a carbody 202 (which may include a turntable 208) with a track system including a first track chain 204*a* and a second track chain 204*b* positioned at opposite sides of carbody 202. Machine 200 is shown in the context of an electric rope shovel having an operator cab 206, a boom 210, a lower end 212 of the boom 210 (also called a boom foot), an upper end 214 of the boom 210 (also called a boom point), tension cables 216, a gantry tension member 218, a gantry compression member 220, a sheave 222 rotatably mounted on the upper end 214 of the boom 210, a dipper 300, a dipper door 302 pivotally coupled to the dipper 300, a hoist rope 228, a winch drum (not shown), and a dipper handle 230. An electric motor controls the winch drum, causing the lowering or raising of the boom, dipper, and upward and downward movement of the dipper handle relative to the boom.

Tracks 204*a* and 204*b* are part of a machine undercarriage 232 coupled with carbody 202 in a conventional manner. Each of tracks 204*a* and 204*b* include a plurality of coupled together track shoes forming endless loops extending about a plurality of rotatable elements. In a typical design, an idler 234 and a drive sprocket 236 will be associated with each of tracks 204*a* and 204*b* and mounted to a track roller frame 238. A plurality of track rollers 240 may also be mounted to roller frame 238, and are associated with each of tracks 204*a* and 204*b* to support machine 200 and guide tracks 204*a* and 204*b* in desired paths, as further described herein. One or more carrier rollers 242 (or track sliders) may also be associated with each of tracks 204*a* and 204*b* to support and guide the tracks opposite rollers 240 during operation.

The unique design of tracks 204*a* and 204*b* and the overall track and undercarriage system of which they are a part are contemplated to enable machine 200 to operate in certain environments such as oil sands. While use in the machine environment of an electric roper shovel and dipper is emphasized herein, it should be understood that machine 200 might comprise a different type of machine. For instance, track-type tractors or even half-track machines are contemplated herein. Further still, machine 200 might consist of a conveyor or other type of machine wherein tracks are used for purposes other than as ground engaging elements. Also, the machine might be some type of hydraulic shovel, bulldozer, excavator, back hoe, etc.

The dipper 300 is suspended from the boom 210 by the hoist rope 228. The hoist rope 228 is wrapped over the sheave 222 and attached to the dipper 300 at a bail 244. The hoist rope 228 is anchored to the winch drum (not shown). The winch drum is driven by at least one electric motor (not shown) that incorporates a transmission unit (not shown). As the winch drum rotates, the hoist rope 228 is paid out to lower the dipper 300 or pulled in to raise the dipper 300. The dipper handle 230 is also coupled to the dipper 300. The dipper handle 230 is slidably supported in the saddle block 246, and the saddle block 246 is pivotally mounted to the boom 210 at the shipper shaft (not clearly shown). The dipper handle 230 includes a rack and tooth formation thereon that engages a drive pinion (not shown) mounted in the saddle block 246. The drive pinion is driven by an electric motor and transmission unit (not shown) to extend or retract the dipper handle 230 relative to the saddle block 246.

An electrical power source (not shown) is mounted to the carbody 202 to provide power to a hoist electric motor (not shown) for driving the hoist drum, one or more crowd electric motors (not shown) for driving the crowd transmission unit, and one or more swing electric motors (not shown) for turning the turntable 208. In some cases, one electric motor powers all of the moving components of the shovel. Each of the crowd, hoist, and swing motors is driven by its own motor controller, or is alternatively driven in response to control signals from a controller (not clearly shown).

The track chains 204*a* and 204*b* are considered to be well suited for work in hard underfoot conditions. To this end, the track chains 204*a* and 204*b* may be "high ground pressure" tracks, each having track members durable enough to support a relatively large weight of machine 200. Each of track shoe members has a footprint defined in part by front and back edges, and also defined in part by outboard edges and inboard edges. Each of track shoe members may further include a ground contact area that is equal to its footprint, or less than its footprint only to an extent that adjacent track shoes overlap one another or due to voids disposed on the bottom surface of the track shoe member. Other configurations of the track shoes and track chain assemblies are possible in other embodiments of the present disclosure.

As can be imagined both external and internal wear members may experience abrasion and packing. So, further embodiments will now be discussed that may limit the wear and packing in harsh abrasive environments such as oils ands, etc. However, it is to be understood that these embodiments are equally applicable to other environments and applications.

Such embodiments may have a bolt-on wear member (may also be referred to as a cover) with a dovetail fastening subassembly that replaces the dovetail on the wear member as described earlier herein, allowing the wear member to fit the same mounting base. This cover can drop right down on top of the base. The cover then uses all four sides of the base to take the loads, as opposed to the earlier embodiments discussed herein, where the wear member only uses 3 sides of the base to take the loads, with the spring retainer taking the load on the fourth side. The wear member may eliminate the larger openings disclosed herein that may allow packing to occur. FIG. 30 shows a plurality of wear members and wear member mounting systems installed on the bottom floor of the interior of the dipper.

Figure 31:
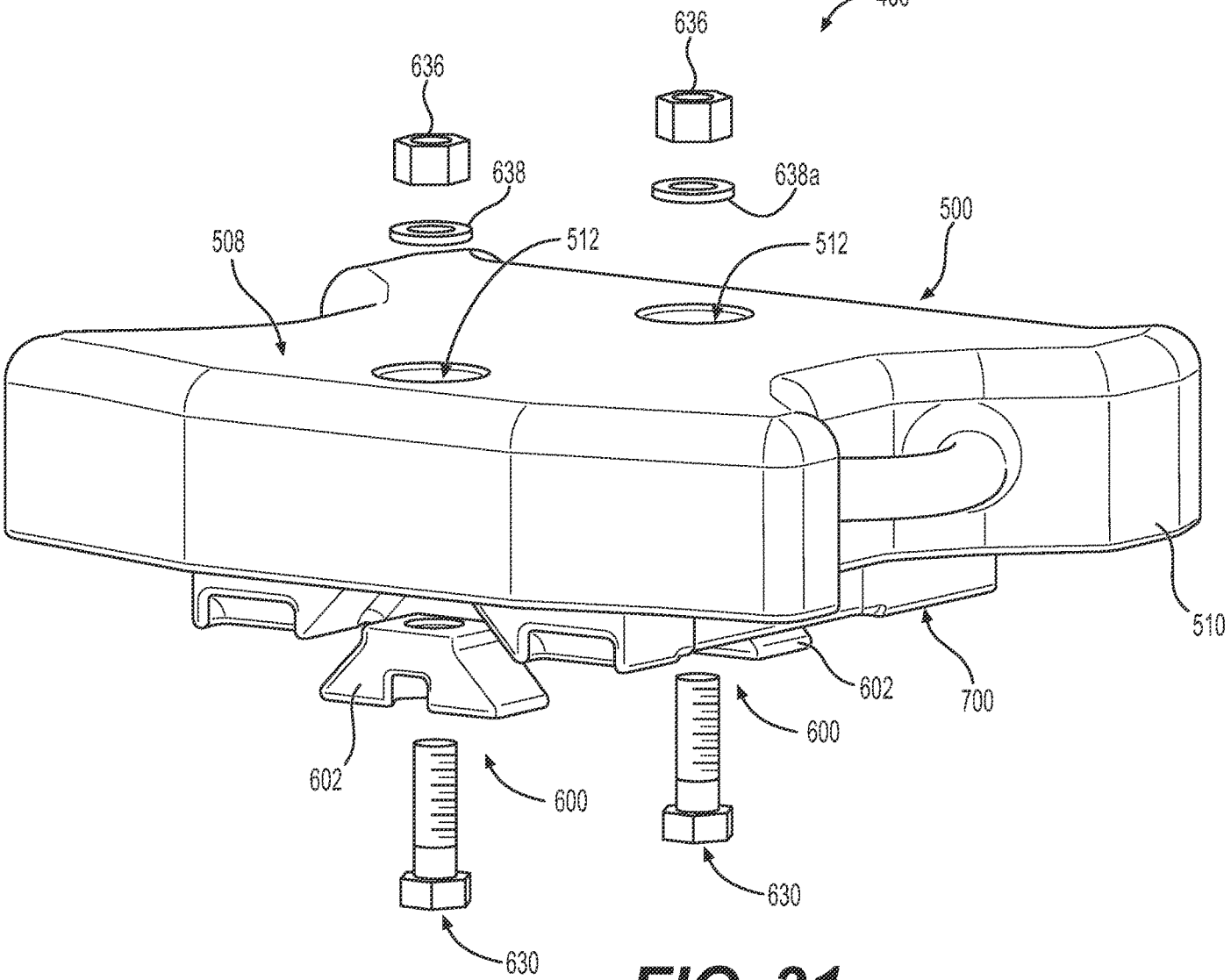
FIG. 31 is an exploded assembly view of a wear member system (may also be referred to as a wear member mounting assembly) including a mounting base assembly according to an embodiment of the present disclosure.

Turning now to FIGS. 31 thru 43, a wear member mounting system 400, 400*a* constructed according to two different embodiments (e.g., system 400 may be larger than system 400*a*) of the present disclosure can be seen. Such a wear member mounting system 400, 400*a* may comprise a mounting base 700 (e.g., see FIG. 32) including an at least partially external polygonal perimeter 702 (other shapes for the perimeter are possible including arcuate), an interior weld receiving aperture 704 (e.g., may have an elongated oval slot shape or racetrack shape, but other configurations, placements, and a plurality are possible), and at least one dovetail slot 706, 706*a* (may open up or enlarge onto the bottom surface 712). A wear member 500, 500*a* (e.g., see FIGS. 31 and 40) may be provided that is configured to be attached to the mounting base 700 by dropping it onto the mounting base instead of sliding it onto the mounting base.

To that end, the wear member 500, 500*a* may define an aperture 502 on its lower surface 506, 506*a* (e.g., see FIGS. 36 and 40, may be a blind aperture that only extends to the bottom surface to help reduce packing) with an at least partially interior polygonal perimeter 504 that is configured to mate with the at least partially external polygonal perimeter 702 of the mounting base 700. Other configurations for these perimeters are possible in other embodiments of the present disclosure.

The wear member mounting system 500, 500*a* may also include at least one dovetail fastening subassembly 600, 600*a* (e.g., see FIGS. 31, 32, 33, 34, 43, 44, one subassembly

600*a* may be smaller than the other subassembly 600, etc.) including a dovetail member 602, 602*a* with a body that is configured to at least partially complementarily fill the at least one dovetail slot 706, 706*a* of the mounting base 700, and that defines a fastener receiving aperture 604, 604*a* extending through the body that has a round portion 606, 606*a* and a non-round portion 608, 608*a*. In some embodiments as shown, the round portion 606, 606*a* includes a cylindrical clearance hole 610, 610*a* (610*a* has about a 18.0 mm diameter for receiving a M16 bolt while 610 has about a 22.0 mm diameter for receiving a M20 bolt), while the non-round portion 608, 608*a* may include a plurality of flat surfaces 612, 612*a* angled relative to each other. More specifically, these flat surfaces may accommodate a hex head of a bolt for preventing its rotation during the assembly process, etc.

Figure 37:
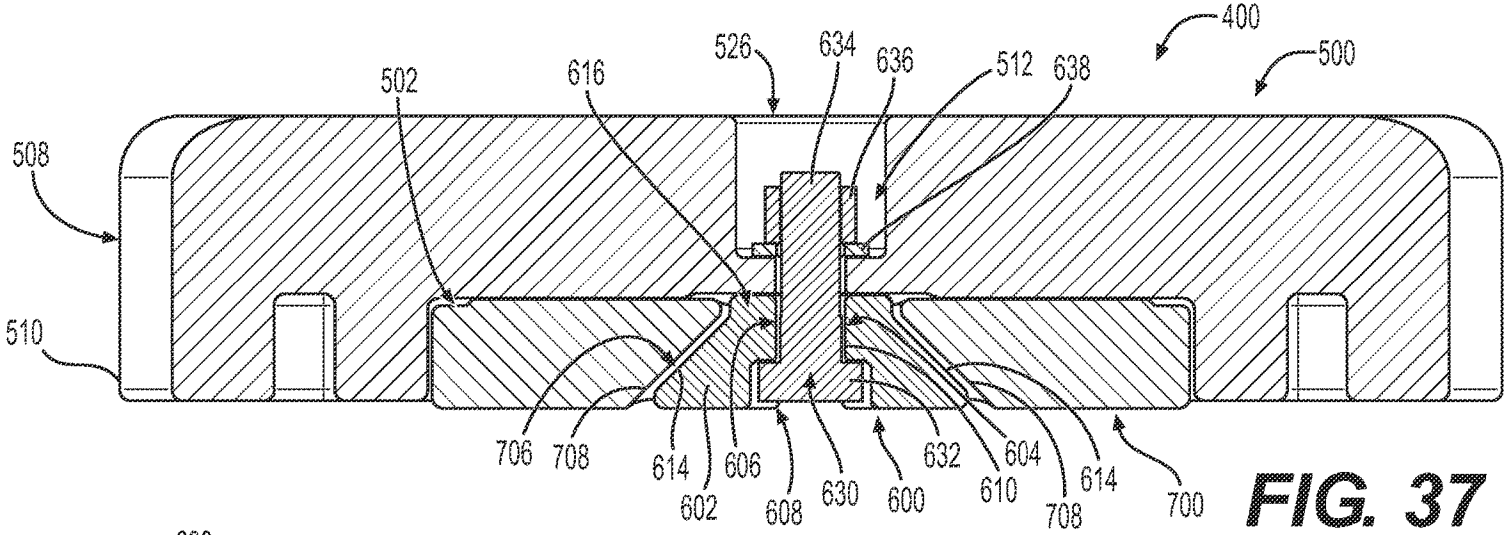
FIG. 37 is a sectional view of the wear member system of FIG. 35 taken along lines 37-37 thereof.
Figure 34:
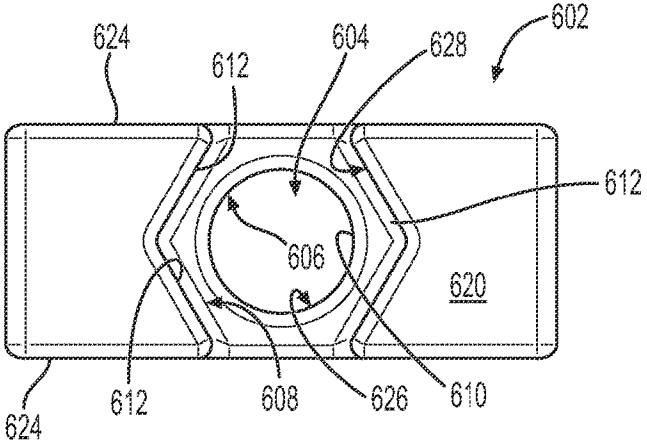
FIG. 34 is a top view of the dovetail member of FIG. 33.
Figure 41:
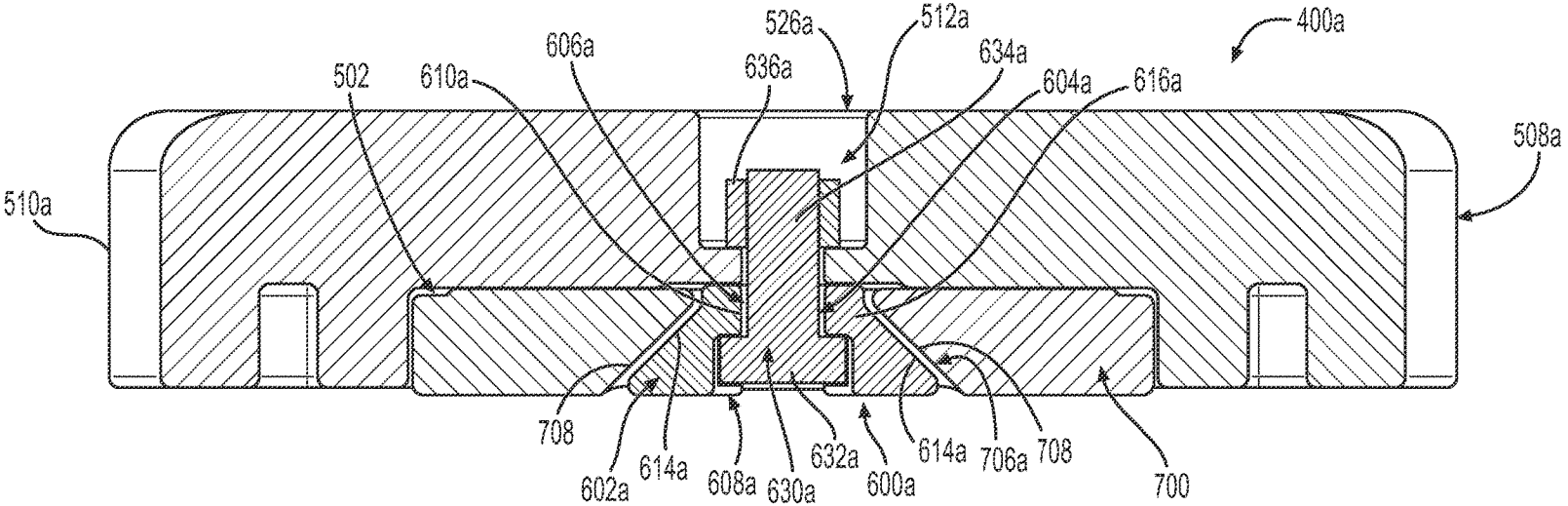
FIG. 41 is a sectional view of the wear member system of FIG. 39 taken along lines 41-41 thereof.

Looking at FIGS. 37 and 41, the at least one dovetail slot 706, 706*a* includes a pair of angled sidewalls 708, and the body of the dovetail member 602, 602*a* may include a pair of sloped surfaces 614, 614*a* that mate with (i.e., may contact or nearly contact) the angled sidewalls 708. As shown, a clearance of 2.0 mm may be provided, but not necessarily so. That is to say, the design may be line to line or a pre-load may be provided, etc. The shape of these features may not necessarily be flat, but could be arcuate such as when a pin round style dovetail or partially pin round style dovetail is employed. Also, a T-slot styled dovetail with right angled surfaces may be employed, etc.

Referring back to FIG. 32, the mounting base may include a top surface 710, and a bottom surface 712 (so called since this surface is nearest the mounting surface of the work tool). At least one dovetail slot 706 may be disposed inside the at least partially external polygonal perimeter 702, and is in communication with a T-slot that extends through the top surface 710 and the bottom surface 712 of the mounting base 700. The T-slot 712 may be omitted in other embodiments of the present disclosure. Another dovetail slot 706*a* may extend through the top surface 710 and the bottom surface 712, while also extending to the at least partially external polygonal perimeter 702. This may not be the case in other embodiments of the present disclosure. For example, either dovetail slot may be omitted or both slots may be disposed toward the interior of the mounting base 700, etc.

Figure 33:
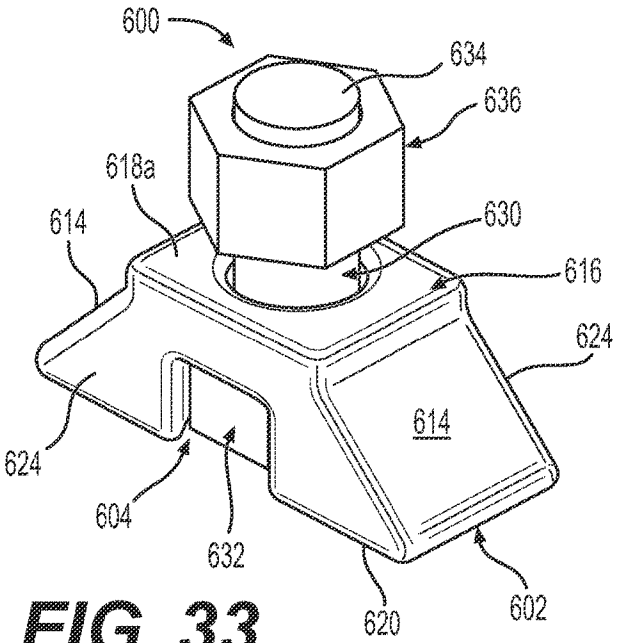
FIG. 33 is a perspective view of a dovetail fastening subassembly of FIG. 32 including a dovetail member, a bolt (e.g., a M20 bolt), and a nut, etc.
Figure 43:
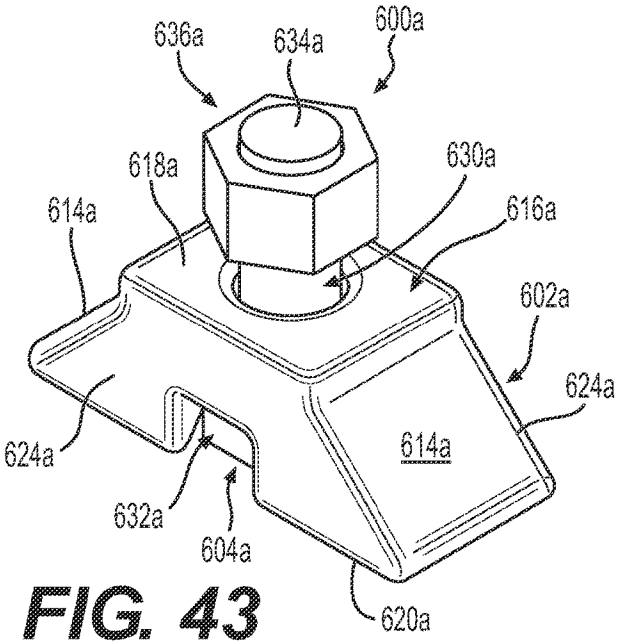
FIG. 43 is a perspective view of the dovetail fastening subassembly (may use M16 bolts) used in the wear member system of FIGS. 39-42.
Figure 44:
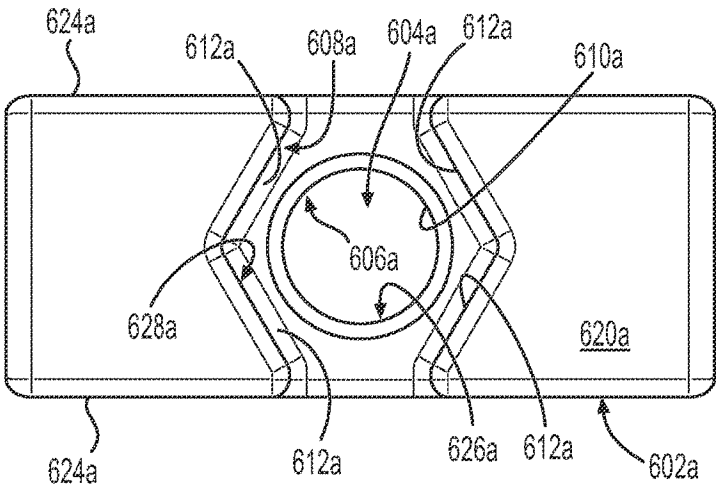
FIG. 44 is a top view of the dovetail member of FIG. 43.

FIGS. 33 and 43 show that the dovetail member 602, 602*a* may include a rectangular pad 616, 616*a* extending upwardly from the pair of sloped surfaces 614, 614*a*, forming a top surface 618, 618*a*. Also, the pair of sloped surfaces 614, 614*a* may extend to a bottom surface 620, 620*a*. The round portion 606, 606*a* of the fastener receiving aperture 604, 604*a* extends from the top surface 618, 618*a*, whereas the non-round portion 608, 608*a* of the fastener receiving aperture 604, 604*a* extends from the bottom surface 620, 620*a* to the round portion 606, 606*a*. Specifically, the round portion 606, 606*a* may include a cylindrical clearance hole 610, 610*a*, while the non-round portion 608, 608*a* may include a plurality of flat surfaces 612, 612*a* angled relative to each other. For example, these surfaces may be configured to mate with a hex head or a square head of a bolt, or the like. Other configurations are possible in other embodiments of the present disclosure.

In the field, the wear member mounting system 400, 400*a* is typically assembled by first attached the mounting base 700 to a surface of a work tool (e.g., via welding). Then, the dovetail fastening subassembly(s) 600, 600*a* are placed into the dovetail slot(s). If the dovetail slot includes a T-slot, then the subassembly is inserted down into the T-slot and slid until it reaches the dovetail slot. If the dovetail slot is at the perimeter, then the subassembly is simply slid into the dovetail slot. Next, the wear member 500, 500*a* is placed down onto the mounting base, allowing the fasteners to pass through its counterbores 526, 526*a*. Nuts 636, 636*a* are then tightened to secure the wear member.

The dovetail fastening subassemblies need to be assembled first if not already supplied in the assembled state. The fastener would simply need to be inserted through the bottom surface of the dovetail member until its head reaches the partial counterbore with flat surfaces.

In practice, a wear member, a mounting base, a dovetail fastening subassembly, a wear member mounting system, and/or any component thereof may be sold, manufactured, bought etc. in the aftermarket or original equipment scenarios according to any of the embodiments discussed herein. That is to say, the machine may be sold with the dipper, and/or wear member mounting system, etc. according to embodiments described herein or the machine may be retrofitted, repaired, or refurbished to use any of the embodiments discussed herein. Similarly, any dipper or other work tool may be retrofit or repaired using any embodiment of the present disclosure.

For example, a wear member 500, 500*a* that may be provided as a replacement part may comprise, as shown in FIGS. 31, and 36-42, a body defining an exterior 508, 508*a* with an outside perimeter 510, 510*a*, an interior aperture 502 with an at least partially interior polygonal perimeter 504, and at least one fastener receiving hole 512, 512*a* extending from the exterior 508*a* to the interior aperture 502.

Figure 36:
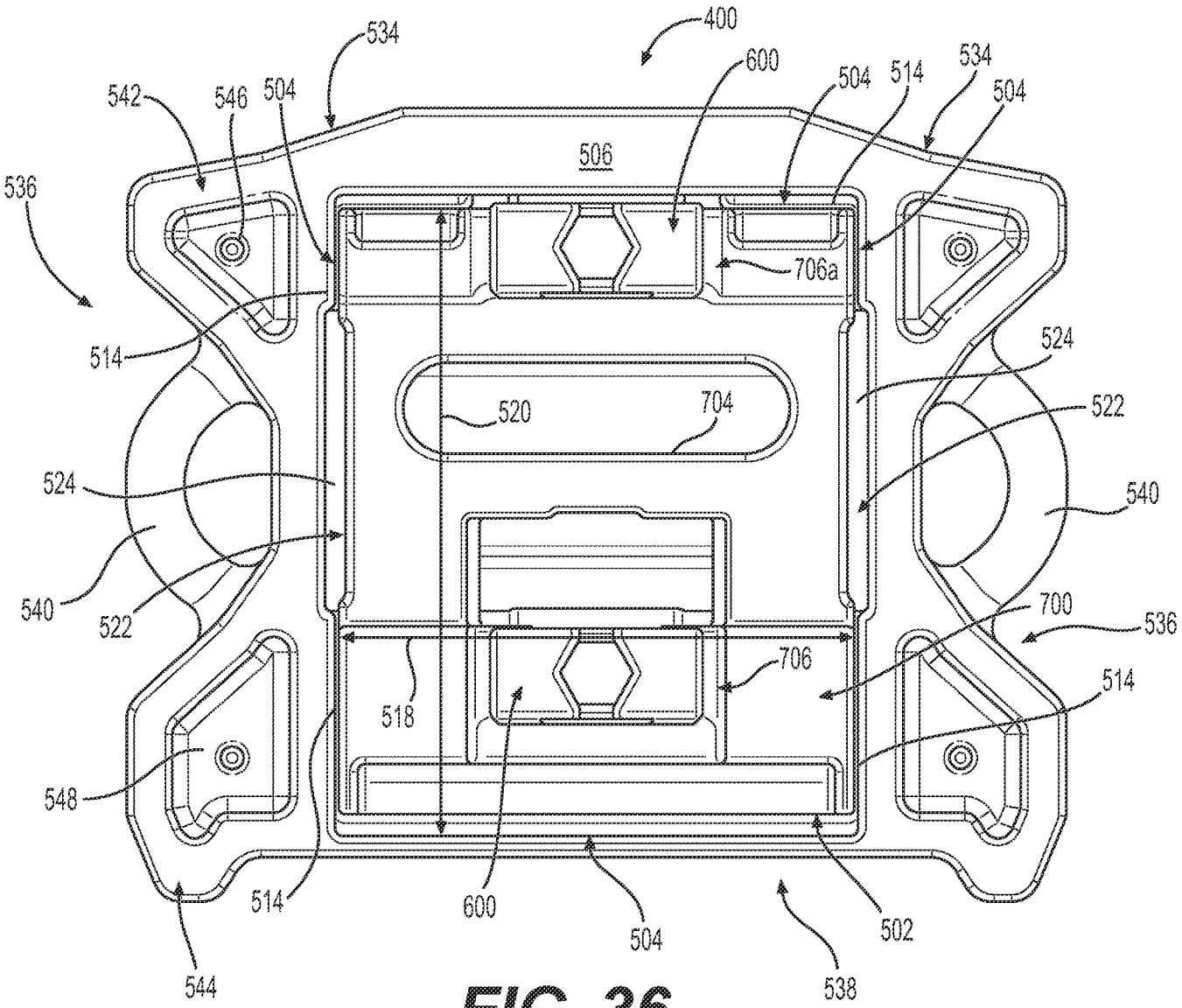
FIG. 36 is a bottom view of the wear member system of FIG. 35.
Figure 40:
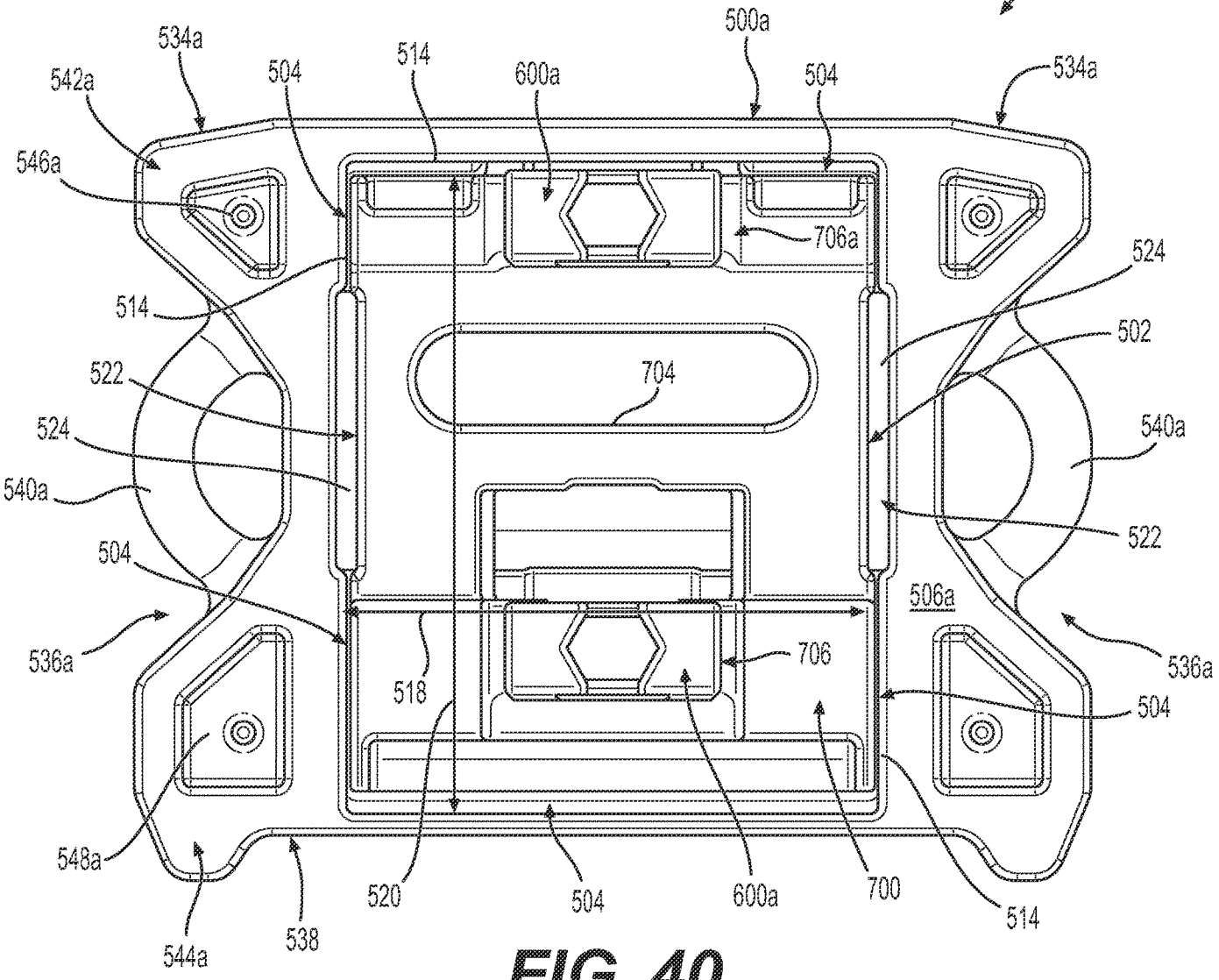
FIG. 40 is a bottom view the wear member system of FIG. 39.

As best seen in FIGS. 36 and 40, the at least partially interior polygonal perimeter is formed by a series of fit pads 514 that form a rectangular configuration (pads may be disposed at the corners of the rectangular configuration, and may protrude about 25.0 mm) with an aperture depth 516 (see also FIGS. 38 and 42), an aperture width 518, and an aperture length 520. A ratio of the aperture width 518 to the aperture length 520 may range from 0.75 to 0.90 in some embodiments of the present disclosure. Other ratios are possible for smaller and bigger applications, etc.

More particularly, the aperture length 520 may range from 155.0 mm to 235.0 mm, the aperture width 518 may range from 118.0 mm to 200.0 mm, and the aperture depth 516 may range from 18.0 mm to 29.0 mm. Other dimensional ranges are possible in other embodiments of the present disclosure. A pair of the series of fit pads 514 are separated along a direction parallel with the aperture length by a pry slot 522 (see also FIGS. 36 and 42) including an angled pry surface 524.

Figure 42:
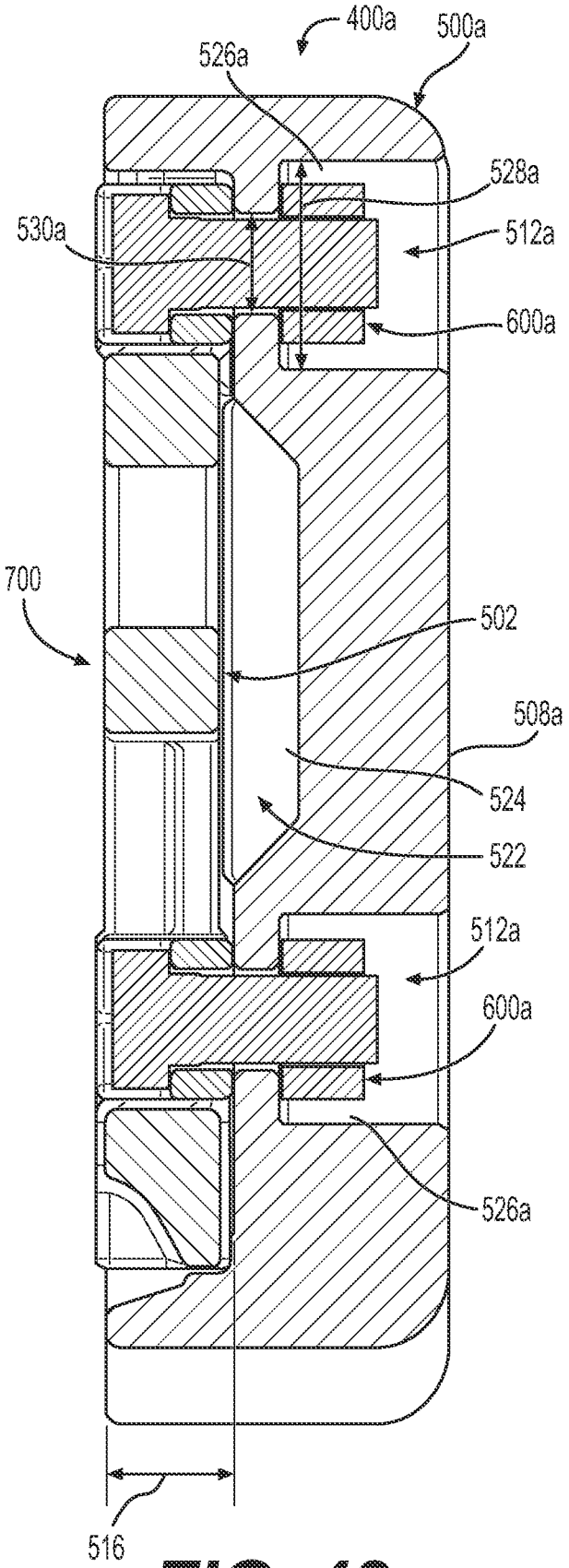
FIG. 42 is sectional view of the wear member system of FIG. 39 taken along lines 42-42 thereof.

With continued reference to FIGS. 36 and 42, the fastener receiving hole 512, 512*a* may take the form of a counterbore 526, 526*a* defining a larger diameter portion defining a large diameter 528, 528*a*, and a small diameter portion defining a small diameter 530, 530*a*. A ratio of the large diameter 528, 528*a* to the small diameter 530, 530*a* may range from 2.0 to 2.75 in some embodiments of the present disclosure. When present, it may easier to clean the counterbore out with the head of the fastener present in the counterbore, easing disassembly. This may not be the case for other embodiments of the present disclosure.

Figure 38:
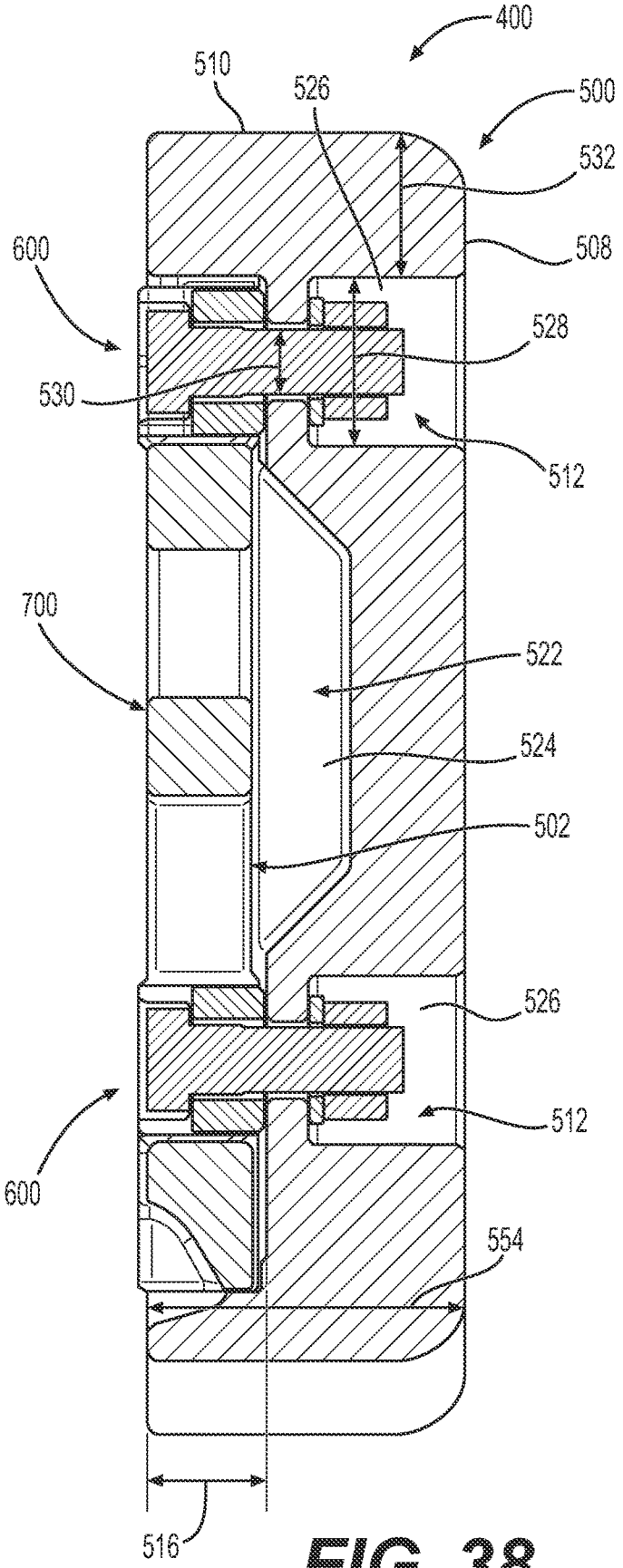
FIG. 38 is a sectional view of the wear member system of FIG. 35 taken along lines 38-38 thereof.

Referring now to FIG. 38, the fastener receiving hole 512 defines a diameter (e.g., large diameter 528) that is spaced away a minimum distance 532 from the outside perimeter 510. A ratio of the minimum distance 532 to the diameter 528 may range from 0.77 to 0.92 in some embodiments of the present disclosure. This ratio may balance the cleaning benefit just discussed and the structural integrity of the wear member. This ratio may not be necessary in some applications where cleaning or structural integrity are not an issued (such as when a suitably durable material is used, etc.).

As best seen in FIGS. 35, 36, 39 and 40, the outside perimeter 510, 510*a* may define an upper sloping portion 534, 534*a*, a pair of side recess 536, 536*a*, and a bottom notch 538. A lifting eye 540, 540*a* may be disposed in each of the pair of side recesses 536, 536*a*. Also, the outside perimeter 510, 510*a* defines a first projection 542, 542*a* between the upper sloping portion 534, 534*a*, and the lifting eye 540, 540*a*, as well as a second projection 544, 544*a* between the bottom notch 538, and the lifting eye 540, 540*a*. Moreover, the wear member includes a bottom surface (or lower surface 506, 506*a*, see FIGS. 36 and 40) defining a first cavity 546, 546*a* on the bottom surface at the first projection 542, 542*a*, and a second cavity 548, 548*a* on the bottom surface at the second projection 544, 544*a*. These cavities may core out excess material, which may reduce cost and help to prevent problems associated with the casting process including voids, porosity, sinks, etc.

Also, this overall outside perimeter is not purely rectangular or square, which may help the wear member(s) grab onto material, encourage filling of the bucket, and decrease the likelihood of packing material underneath the wear member into the attachment structure. This may provide more efficient wear protection than simply shaped wear members known in the art.

It should be noted that the sectioned planes of FIGS. 38 and 42 may also represent planes of symmetry for the wear member. Accordingly, various features such as those just discussed may be mirrored about these planes, but not necessarily so.

Figure 35:
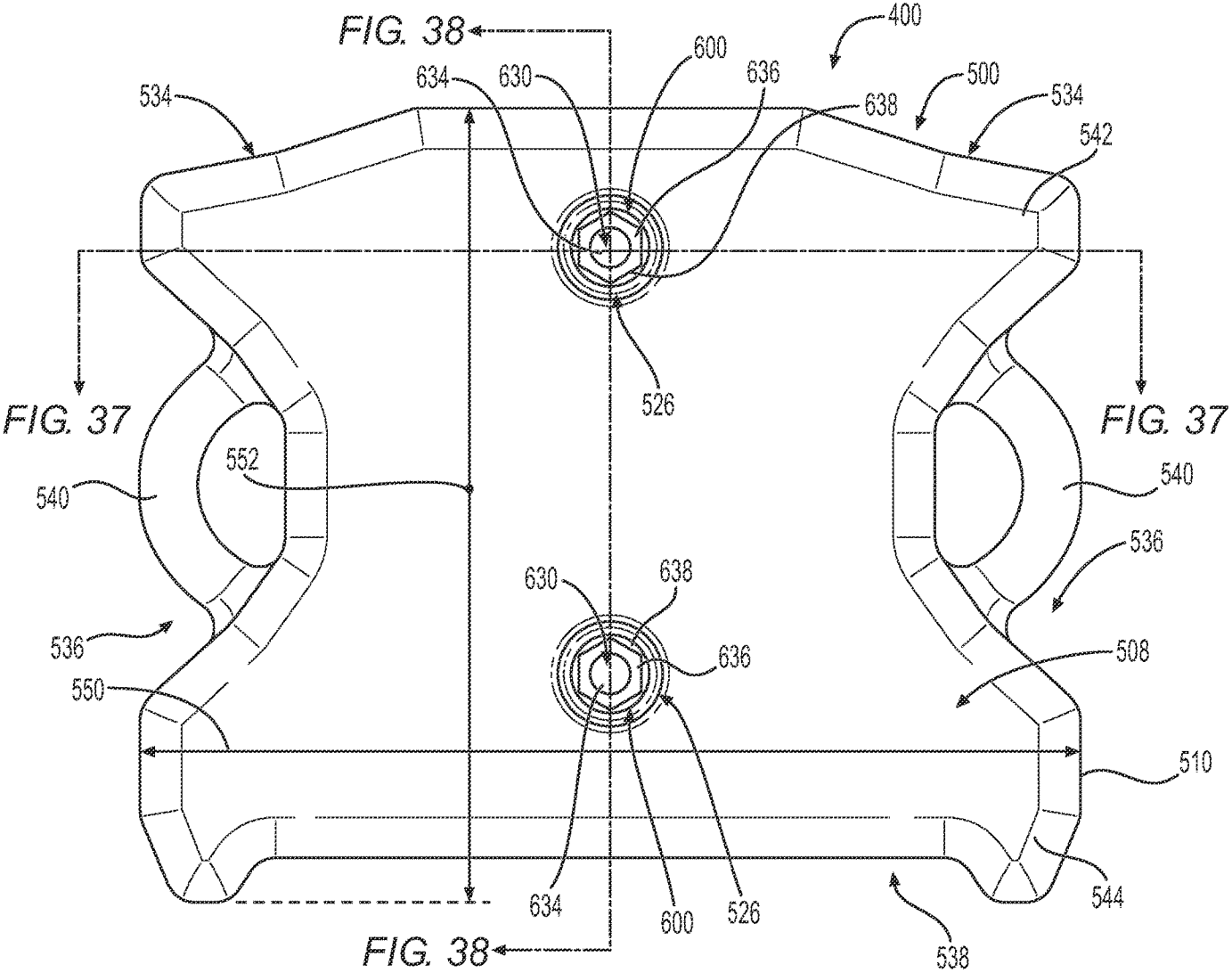
FIG. 35 is a top view of the wear member system of FIG. 31 shown assembled.
Figure 39:
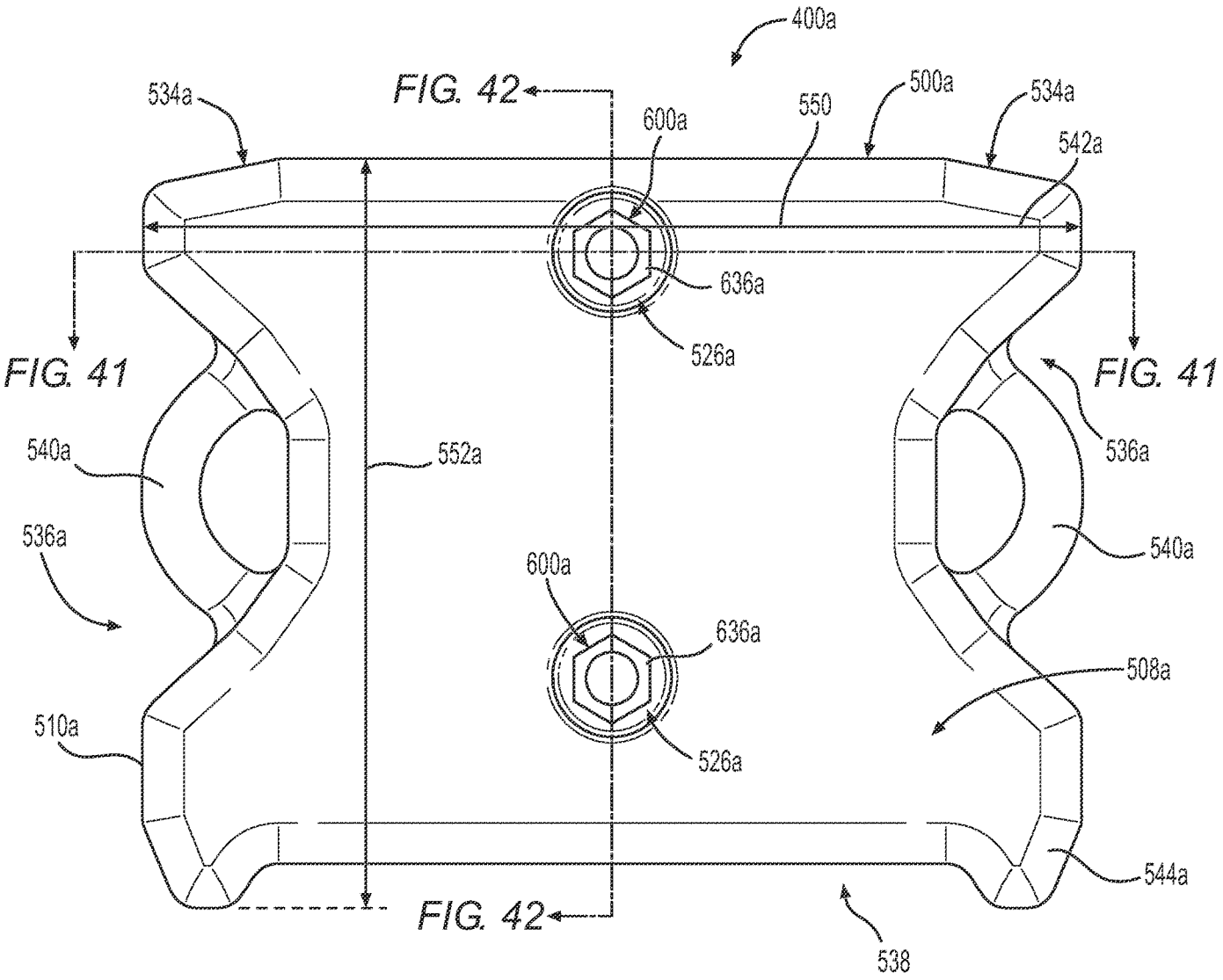
FIG. 39 is a top view of another embodiment of a wear member system (e.g., smaller design than that shown in FIG. 35, may us M16 bolts instead of M20 bolts) shown assembled.

Looking at FIGS. 35 and 39, it may be understood that the outside perimeter 510, 510*a* defines a width 550, and a length 552, 552*a*. A ratio of the width 550 to the length 552, 552*a* may range from ranges from 1.05 to 1.32 in some embodiments of the present disclosure. In such a case, the length may range from 275.0 mm to 350.0 mm, the width may range from 360.0 mm to 370.0 mm, and the body may define a thickness 554 (see FIG. 38) that ranges from 70.0 mm to 80.0 mm. Other ratios and dimensional ranges are possible in other embodiments of the present disclosure.

In the assembled state, 1.0 mm of clearance may be provided between the mounting plate and the sides of the aperture of the wear member, with 5.0 mm of clearance being provided near the front of the assembly (area near the bottom notch 538). These clearances may be adjusted.

Turning to FIGS. 33, 34, 43, and 44, the dovetail fastening subassembly 600, 600*a* that may be provided as a replacement or a retrofit in the field may comprise a dovetail member 602, 602*a* including a body that has an at least partially pyramidal configuration (e.g., sloped surfaces 614, 614*a*, with flat side surfaces 624, 624*a*, etc.) defining a fastener receiving aperture 604, 604*a* extending through the body that defines a surface of revolution 626, 626*a*, and a surface of non-revolution 628, 628*a*.

The subassembly may further comprise a bolt 630, 630*a* with a head 632, 632*a*, and a shaft 634, 634*a*. The head 632, 632*a* matches the surface of non-revolution 628, 628*a*, while the shaft 634, 634*a* matches the surface of revolution 626, 626*a*. As a result, the bolt may pass through the dovetail member exposing its free end that is externally threaded. A nut 636, 636*a* may be threaded onto the shaft, which remains stationary due to the matching of the head with the surface of non-revolution. Examples of the bolts that may be employed include a M16 bolt, a M20 bolt, etc.

Figure 45:
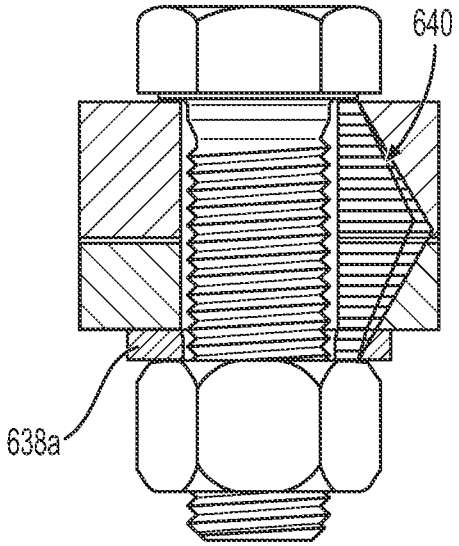
FIG. 45 is a partial sectional view of a fastening joint that may be employed by the various embodiments discussed herein.

FIGS. 37 and 45 provide a general example of what the bolted joint would look when assembled. A washer (638, 638*a*) is also provided. The stress profile 640 in FIG. 45 has been determined by the inventors to be acceptable for at least some applications.

Figure 32:
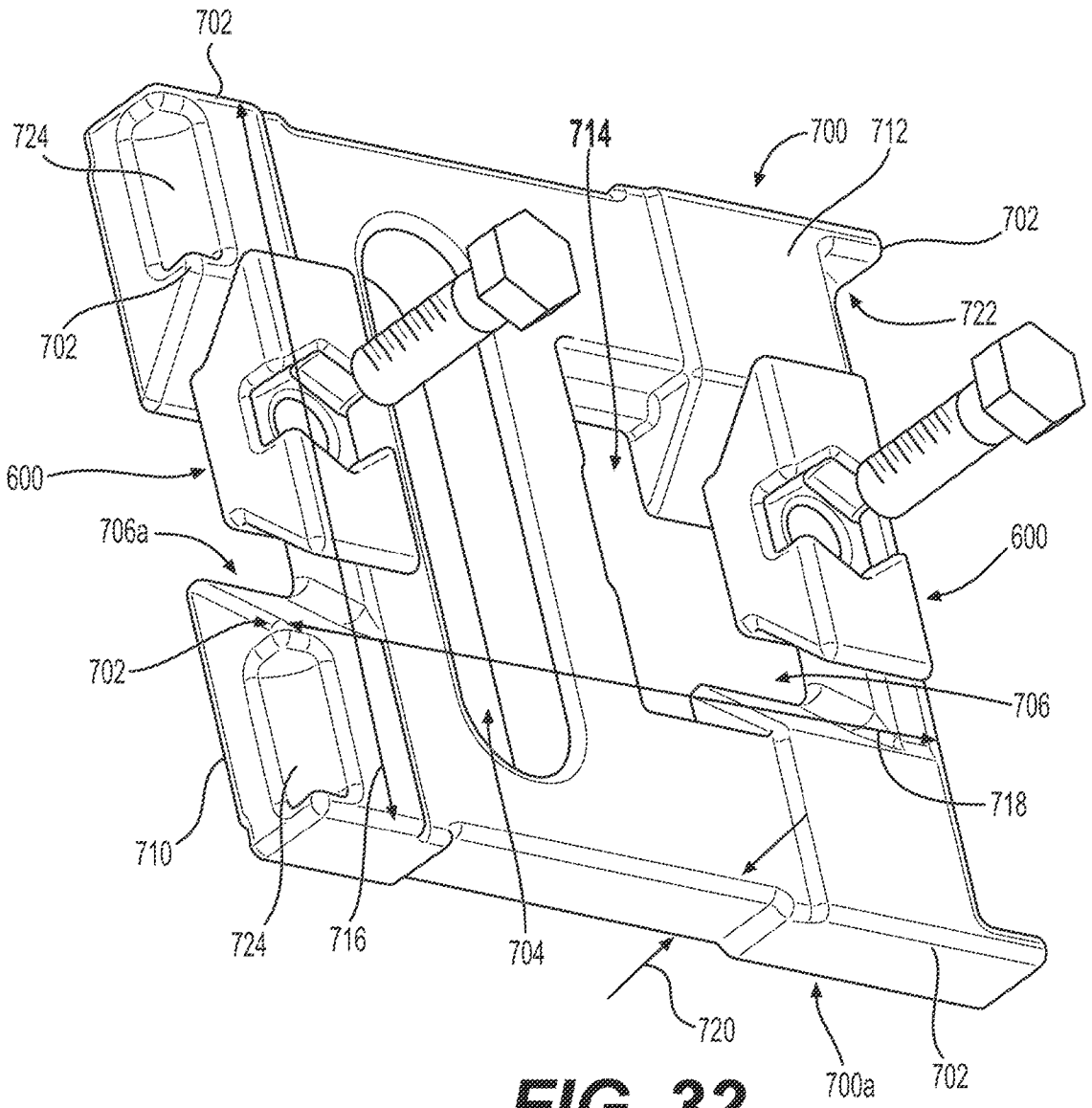
FIG. 32 is an exploded assembly view of the mounting base assembly of FIG. 31 including a pair of dovetail fastening subassemblies.

A mounting plate 700*a* that may be provided as a replacement or retrofit in the field is shown in FIG. 32. The mounting plate 700*a* may comprise a plate body defining a plate length 716, a plate width 718, and a plate thickness 720 that is less than the plate length 716 and plate width 718.

The plate body may further define an internal dovetail slot (e.g., see 706), an external dovetail slot (e.g. see 706*a*), a T-slot that 714 is in communication with and partially forms the internal dovetail slot, and an elongated slot 722 that is disposed between the T-slot 714, and the external dovetail slot along a direction parallel with the plate length 718.

A pair of pry slots 724 may be disposed on either side of the external dovetail slot (e.g. see 706*a*) along a direction parallel with the plate width 716, and an elongated pry slot 722 that is disposed proximate to the internal dovetail slot (e.g., see 706) along a direction parallel with the plate length 718.

Figure 46:
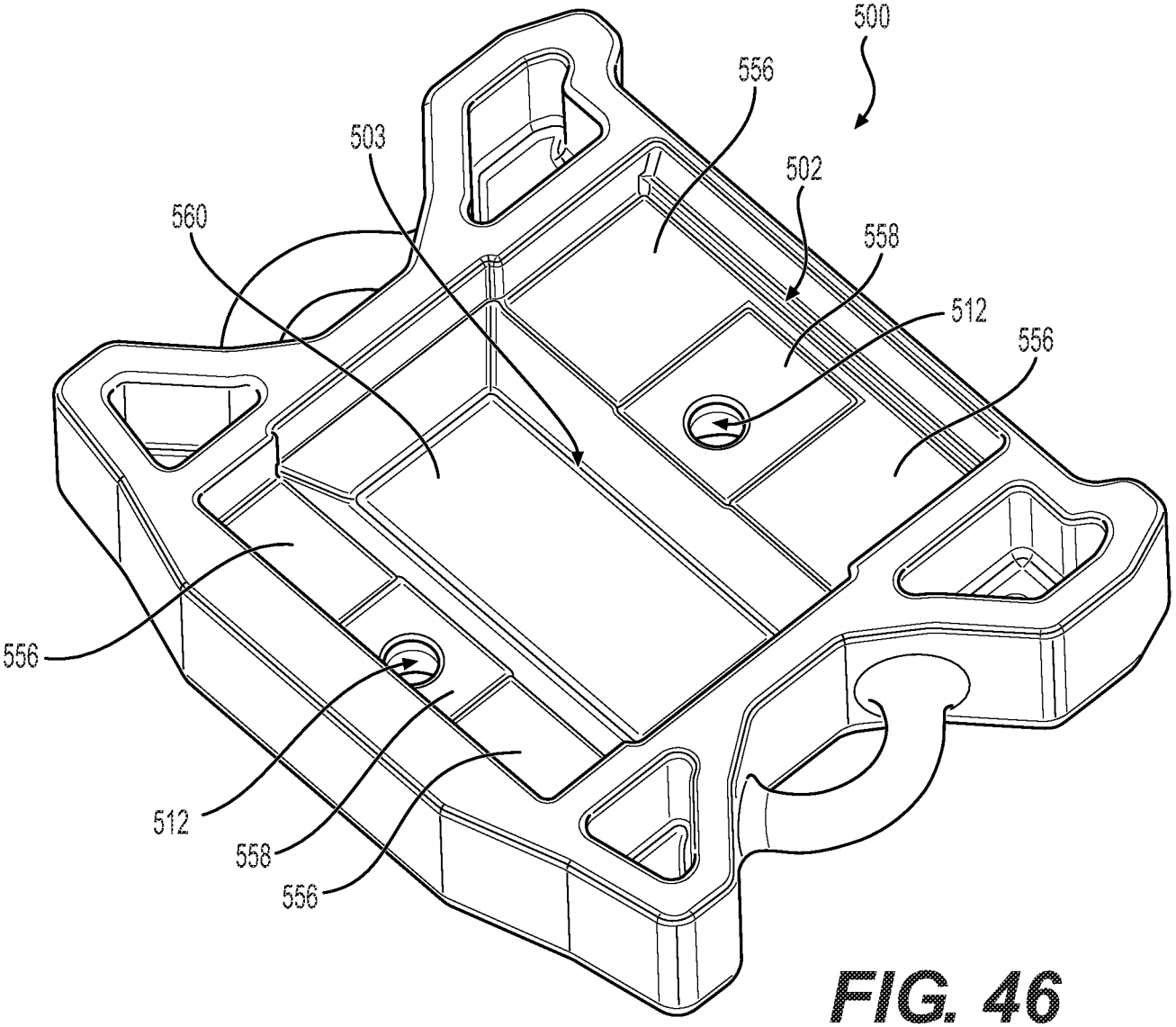
FIG. 46 is a bottom oriented perspective view of the wear member of FIG. 36 with the mounting plate and the dovetail fastening assemblies removed, revealing the structure of its bottom pocket.

FIG. 46 illustrates that the floor 503 of the bottom aperture 502 may not be contiguous or flat, but instead may have a plurality of surfaces positioned at different levels. For example, the floor 503 may include a series of mounting pads 556 (e.g., four of them positioned at each corner of the aperture 502), a pair of shallow pockets 558 (e.g., may have a depth of 30.0 mm or less) disposed between a pair of the mounting pads, each pocket surrounding a fastener receiving aperture or hole, and a large clearance pocket 560 (e.g., may have a depth of greater than 30.0 mm) in the middle of the aperture 502 that separates one set of mounting pads and pockets from another set. Other configurations are possible in other embodiments of the present disclosure.

While the arrangement is illustrated in connection with an electric rope shovel, the arrangement disclosed herein has universal applicability in various other types of machines commonly employ track systems, as opposed to wheels. The term "machine" may refer to any machine that performs some type of operation associated with an industry such as mining or construction, or any other industry known in the art. For example, the machine may be an excavator, wheel loader, cable shovel, or dragline or the like. Moreover, one or more implements may be connected to the machine. Such implements may be utilized for a variety of tasks, including, for example, lifting and loading.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A wear member mounting system comprising:

a mounting base including:

an at least partially external polygonal perimeter, an interior weld receiving aperture, and at least one dovetail slot;

a wear member defining:

an aperture with an at least partially interior polygonal perimeter that is configured to mate with the at least partially external polygonal perimeter of the mounting base; and at least one dovetail fastening subassembly including:

a dovetail member having:

a body that is configured to at least partially complementarily fill the at least one dovetail slot; and a fastener receiving aperture extending through the body that defines a round portion and a non-round portion, wherein the at least one dovetail slot includes a pair of angled sidewalls, wherein the body of the dovetail member includes a pair of sloped surfaces that mate with the angled sidewalls, and wherein the dovetail member includes a rectangular pad extending upwardly from the pair of sloped surfaces, forming a top surface, and wherein the pair of sloped surfaces extend to a bottom surface.

2. The wear member mounting system of claim 1, wherein the interior weld receiving aperture includes an elongated oval slot shape.

3. The wear member mounting system of claim 1, wherein the mounting base includes a top surface, and a bottom surface, and the at least one dovetail slot is disposed in inside the at least partially external polygonal perimeter, and is in communication with a T-slot that extends through the top surface and the bottom surface of the mounting base.

4. The wear member mounting system of claim 3, wherein the at least one dovetail slot extends through the top surface of the mounting base and the bottom surface of the mounting base, and also extends to the at least partially external polygonal perimeter.

5. The wear member mounting system of claim 1, wherein the round portion of the fastener receiving aperture extends from the top surface of the dovetail member, and the non-round portion of the fastener receiving aperture extends from the bottom surface of the dovetail member to the round portion.

6. The wear member mounting system of claim 5, wherein the round portion includes a cylindrical clearance hole and the non-round portion includes a plurality of flat surfaces angled relative to each other.

7. A wear member comprising:

a body defining:

an exterior with an outside perimeter;

an interior aperture with an at least partially interior polygonal perimeter; and at least one fastener receiving hole extending from the exterior to the interior aperture, wherein the outside perimeter defines an upper sloping portion, a pair of side recesses, and a bottom notch, and wherein the interior aperture includes: (1) a bottom floor with a series of mounting pads, (2) a pair of pockets disposed between a pair of the series of mounting pads, and surrounding the at least one fastener receiving hole, and (3) a clearance pocket disposed in a middle portion of the interior aperture.

8. The wear member of claim 7, wherein the at least partially interior polygonal perimeter is formed by a series of fit pads that form a rectangular configuration with an aperture depth, an aperture width, and an aperture length, and a ratio of the aperture width to the aperture length ranges from 0.75 to 0.90.

9. The wear member of claim 8, wherein the aperture length ranges from 155.0 mm to 235.0 mm, the aperture width ranges from 118.0 mm to 200.0 mm, and the aperture depth ranges from 18.0 mm to 29.0 mm, and a pair of the series of fit pads are separated along a direction parallel with the aperture length by a pry slot including an angled pry surface.

10. The wear member of claim 7, wherein the at least one fastener receiving hole is a counterbore defining a larger diameter portion defining a large diameter, and a small diameter portion defining a small diameter, and a ratio of the large diameter to the small diameter ranges from 2.0 to 2.5.

11. The wear member of claim 7, wherein the at least one fastener receiving hole defines a diameter that is spaced away a minimum distance from the outside perimeter, and a ratio of the minimum distance to the diameter ranges from 0.77 to 0.92.

12. The wear member of claim 7, further comprising a lifting eye disposed in each of the pair of side recesses, and wherein the outside perimeter defines a first projection between the upper sloping portion, and the lifting eye, and a second projection between the bottom notch and the lifting eye, and the wear member includes a bottom surface defining a first cavity on the bottom surface at the first projection, and a second cavity on the bottom surface at the second projection.

13. The wear member of claim 7, wherein the outside perimeter defines a width, and a length, and a ratio of the width to the length ranges from 1.05 to 1.32.

14. The wear member of claim 13, wherein the length ranges from 275.0 mm to 350.0 mm, the width ranges from 360.0 mm to 370.0 mm, and the body defines a thickness that ranges from 70.0 mm to 80.0 mm.

* * * * *